US008223104B2

(12) United States Patent
Nagatsuka et al.

(10) Patent No.: US 8,223,104 B2
(45) Date of Patent: Jul. 17, 2012

(54) DISPLAY DEVICE AND ELECTRONIC DEVICE HAVING THE SAME

(75) Inventors: Shuhei Nagatsuka, Kanagawa (JP); Akihiro Kimura, Kanagawa (JP); Hiromi Yanai, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1015 days.

(21) Appl. No.: 11/676,751

(22) Filed: Feb. 20, 2007

(65) Prior Publication Data

US 2007/0195078 A1 Aug. 23, 2007

(30) Foreign Application Priority Data

Feb. 23, 2006 (JP) ..... 2006-047194

(51) Int. Cl.
*G09G 3/36* (2006.01)

(52) U.S. Cl. ..... 345/98; 345/99; 345/100

(58) Field of Classification Search ..... 345/98–100
See application file for complete search history.

(56) References Cited

U.S. PATENT DOCUMENTS

| | | | | |
|---|---|---|---|---|
| 6,288,699 | B1 | 9/2001 | Kubota et al. | |
| 6,518,941 | B1 | 2/2003 | Kimura | |
| 6,774,574 | B1 | 8/2004 | Koyama | |
| 6,777,887 | B2 | 8/2004 | Koyama | |
| 6,831,622 | B2 | 12/2004 | Aoki | |
| 7,113,154 | B1 | 9/2006 | Inukai | |
| 7,164,414 | B2 | 1/2007 | Tanaka | |
| 7,358,763 | B2 | 4/2008 | Tanaka | |
| 7,362,301 | B2 | 4/2008 | Sagawa | |
| 2002/0013018 | A1 | 1/2002 | Tanaka | |
| 2002/0153844 | A1 | 10/2002 | Koyama | |
| 2003/0071772 | A1 | 4/2003 | Kimura | |
| 2003/0151713 | A1 | 8/2003 | Aoki | |
| 2004/0104882 | A1 * | 6/2004 | Kitani et al. | 345/100 |
| 2004/0207331 | A1 | 10/2004 | Koyama | |
| 2005/0270059 | A1 * | 12/2005 | Ando | 324/770 |
| 2006/0007208 | A1 | 1/2006 | Aoki | |
| 2006/0125525 | A1 | 6/2006 | Tanaka | |

(Continued)

FOREIGN PATENT DOCUMENTS

EP 0 949 603 A1 10/1999

(Continued)

OTHER PUBLICATIONS

Japan 11-073158 : English abstract provided by esp@cenet Worldwide (2007) and family to U.S. Patent No. 6,518,941 (Desig. ID "AD"), U.S. Patent Application Publication No. 2003/0071772 (Desig. ID "AB") and European Patent Application Publication No. 0 949 603 (Desig. ID "AK").

(Continued)

*Primary Examiner* — Amr Awad
*Assistant Examiner* — Jonathan Boyd
(74) *Attorney, Agent, or Firm* — Fish & Richardson P.C.

(57) ABSTRACT

A display device includes a phase comparator which compares whether phases of two signals which are input are different from each other or not; a counter circuit which counts the number of the cases where a phase shift is detected in the phase comparator; and a phase shift circuit which can output a signal in which the phase shift is restored by shifting a phase of one of the two signals in accordance with a degree of the number of phase shifts which is counted in the counter circuit.

18 Claims, 22 Drawing Sheets

U.S. PATENT DOCUMENTS

| | | | | |
|---|---|---|---|---|
| 2006/0214928 | A1* | 9/2006 | Koyama | 345/204 |
| 2008/0191988 | A1 | 8/2008 | Tanaka | |

FOREIGN PATENT DOCUMENTS

| | | | |
|---|---|---|---|
| EP | 1 063 630 | A2 | 12/2000 |
| EP | 1 103 946 | A2 | 5/2001 |
| EP | 1178607 | A2 | 2/2002 |
| JP | 11-073158 | | 3/1999 |
| JP | 2000029420 | A | 1/2000 |
| JP | 2001-005426 | | 1/2001 |
| JP | 2001228827 | A | 8/2001 |
| JP | 2001-343933 | | 12/2001 |
| JP | 2002229517 | A | 8/2002 |
| JP | 2003157064 | A | 5/2003 |
| JP | 2004045705 | A | 2/2004 |
| JP | 2005107353 | A | 4/2005 |

OTHER PUBLICATIONS

Japan 2001-005426 : English abstract provided by esp@cenet Worldwide (2007) and family to U.S. Patent No. 6,774,574 (Desig. ID "AE"), U.S. Patent No. 6,777,887 (Desig. ID "AF"), U.S. Patent Application Publication No. 2002/0153844 (Desig. ID "AA"), U.S. Patent Application Publication No. 2004/0207331 (Desig. ID "AC") and European Patent Application Publication No. 1 063 630 (Desig. ID "AL").

Japan 2001-343933 : English abstract provided by esp@cenet Worldwide (2007) and family to U.S. Patent No. 7,113,154 (Desig. ID "AG") and European Patent Application Publication No. 1 103 946 (Desig. ID "AM").

European Search Report (Application No. 07002650.5) Dated Jan. 16, 2012, in English.

* cited by examiner

DISPLAY DEVICE AND ELECTRONIC DEVICE HAVING THE SAME

BACKGROUND OF THE INVENTION

1. Field of the Invention

The invention relates to a display device. In particular, the invention relates to a display device having a correction circuit for correcting a phase shift due to a delay of a signal which is input into a wiring. Further, the invention relates to an electronic device including the display device in a display portion.

2. Description of the Related Art

In recent years, a display device in which a semiconductor thin film is formed over an insulator such as a glass substrate, particularly, an active matrix display device using TFTs (Thin Film Transistors) has been widely used. The active matrix display device using TFTs includes hundreds of thousand of TFTs to millions of TFTs in pixel portions which are arranged in matrix, and lighting or non-lighting of each pixel is controlled to display an image.

In such a display device, a TFT is arranged in each pixel and lighting or non-lighting of each pixel is controlled by controlling on/off of the TFT.

In the aforementioned display device, an analog driving method (an analog gray scale method) and a digital driving method (a digital gray scale method) are given as examples of driving methods in the case of displaying a multi-gray scale image.

The analog driving method is a method for continuously controlling the amount of current which is supplied to a light-emitting element to obtain a gray scale. In addition, the digital driving method is a method for driving with only two states of an on state (a lighting state) and an off state (a non-lighting state) of a light-emitting element.

Since the digital driving method can only display two gray scales by itself, combination of the above method and a driving method which displays a multi-gray scale such as an area gray scale method, or combination of the above method and a driving method which displays a multi-gray scale such as a time gray scale method, has been proposed. The area gray scale method is a method in which a subpixel is provided in a pixel and a gray scale is displayed in accordance with a size of a light-emitting area in the subpixel. In addition, the time gray scale method is a driving method for controlling length of period in which a pixel emits light or the number of light emission to display a multi-gray scale. These driving methods are specifically disclosed in Reference 1: Japanese Published Patent Application No. 2001-5426 and Reference 2: Japanese Published Patent Application No. 2001-343933.

SUMMARY OF THE INVENTION

FIG. 22A shows one example of a pixel circuit using an active matrix method in which a light-emitting element is used in a pixel. The circuit configuration shown in FIG. 22A includes a writing transistor 2201 (also described as a first transistor), a driving transistor 2202 (also described as a second transistor), and a light-emitting element 2203. A gate of the writing transistor 2201 is connected to a gate line (also described as a gate signal line or a scan line) GL; a first terminal of the writing transistor 2201 is connected to a source line (also described as a source signal line or a signal line) SL; and a second terminal of the writing transistor 2201 is connected to a gate of the driving transistor 2202. A first terminal of the driving transistor 2202 is connected to a power supply line VL and a second terminal of the driving transistor 2202 is connected to a first terminal of the light-emitting element 2203. A second terminal of the light-emitting element 2203 is connected to an opposite electrode.

Since it is difficult to define which is a source electrode or a drain electrode of a transistor due to its structure, here, one of the source electrode and the drain electrode is described as a first terminal and the other electrode thereof is described as a second terminal.

Next, an operation of the circuit in FIG. 22A is described with reference to timing charts in FIGS. 22B and 22C. Here, the case is described in which the writing transistor 2201 is an N-channel transistor and the driving transistor 2202 is a P-channel transistor. In addition, a signal waveform with respect to a potential of a node $N_S$ of the source line SL and a signal waveform with respect to a potential of a node $N_G$ of the gate line GL are described.

In FIG. 22B, if the node $N_G$ is a signal having a high potential (also described as a High level) when the node $N_S$ is a signal having a low potential (also described as a Low level), a potential of VL is taken in the pixel when the potential of the node $N_S$ is taken in the gate of the driving transistor 2202; therefore, the light-emitting element 2203 in the pixel emits light. In addition, if the node $N_G$ is the signal having the high potential when the node $N_S$ is the signal having the high potential, the potential of VL is not supplied to the light-emitting 2203 when the potential of the node $N_S$ is taken in the gate of the driving transistor 2202; therefore, the light-emitting element 2203 in the pixel turns off light.

However, signals supplied to a pixel portion in which a pixel of a display device is provided would generate a phase shift due to dullness or a delay of the signals caused by resistance, a capacitance component, or the like of a wiring to which the signals are supplied. FIG. 22C shows a timing chart in the case where this phase shift of the signal occurs.

Also in FIG. 22C, the potential of the node $N_S$ is taken in the pixel when the potential of the node $N_G$ is at a High level. However, in FIG. 22C, when the potential of the node $N_G$ is at a High level, the potential of the node $N_S$ lowers from a High level to a Low level, or rises from a Low level to a High level. Therefore, normal display cannot be obtained in actual display, so that a malfunction such as displaying a portion which is originally supposed not to be displayed or not displaying an image which is supposed to be displayed is generated.

In view of the foregoing problems, it is an object of the invention to provide a display device which detects a phase shift in the case where phases of two signals are shifted due to parasitic resistance or parasitic capacitance in a wiring for supplying a signal, and further restores the phase shift of the signals inside the display device so that normal display can be obtained.

In order to solve the aforementioned problems, the invention includes a phase comparator which compares whether phases of two signals which are input are different from each other or not, a counter circuit which counts the number of the cases where phase shifts are detected in the phase comparator, and a phase shift circuit which can output a signal where the phase shifts are restored by shifting the phase of one of the two signals in accordance with a degree that phase shifts are counted in the counter circuit. Hereinafter, specific structures of the invention are described.

A display device in accordance with one aspect of the invention includes a gate signal line, a source signal line, a phase comparator which compares a potential of a signal output into the gate signal line with a potential of a signal output into the source signal line, a counter circuit which counts the number of signals output from the phase comparator, and a phase shift circuit which shifts a phase of the signal output into the gate signal line based on a signal output from the counter circuit.

In addition, a display device in accordance with another aspect of the invention includes a gate signal line into which a first signal and a second signal are output, a source signal line into which a video signal is output, a phase comparator which compares a phase of the first signal with a phase of the video signal and compares a phase of the second signal with the phase of the video signal, a first counter circuit which counts the number of signals which are output by comparing the phase of the first signal with the phase of the video signal in a signal output from the phase comparator, a second counter circuit which counts the number of signals which are output by comparing the phase of the second signal with the phase of the video signal in the signal output from the phase comparator, a first phase shift circuit which shifts the phase of the first signal based on a signal output from the first counter circuit, and a second phase shift circuit which shifts the phase of the second signal based on a signal output from the second counter circuit.

In addition, a phase comparator of the invention may have a configuration including a logic circuit.

In addition, a counter circuit of the invention may have a configuration including a D flip-flop circuit and plurality of logic circuits which output a signal in accordance with a signal output from the D flip-flop circuit.

Further, a phase shift circuit of the invention may have a configuration including a shift register circuit for shifting a phase of a signal output into a gate signal line and an analog switch which is provided in each stage of the shift register circuit and on/off of which is switched in accordance with the number of signals counted in a counter circuit.

By employing the invention, particularly in the case of driving by using a digital driving method in an active matrix display device, a phase shift of signals is counted and restored inside the display device so that normal display can be obtained, even when phases of a scan signal and an image signal input into a pixel portion are shifted by dullness or delay of the signals caused by resistance, a capacitance component, or the like of the wiring to which the signals are supplied.

DETAILED DESCRIPTION OF THE INVENTION

Figure 1A:
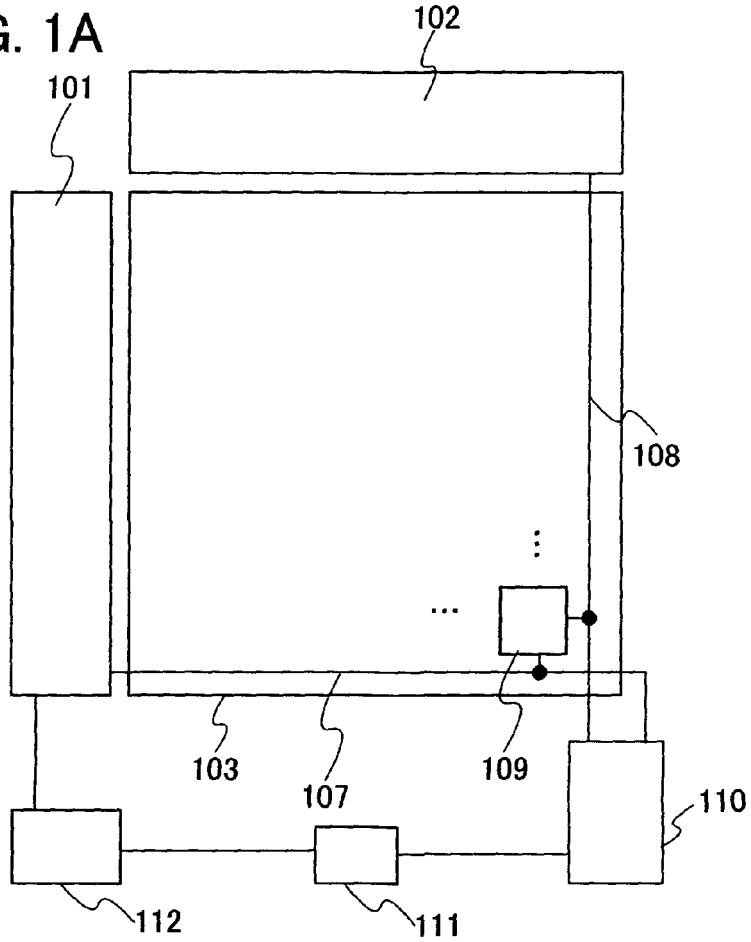
FIGS. 1A and 1B are block diagrams for showing a structure of the invention.

Hereinafter, the invention will be described by way of embodiment modes and an embodiment with reference to the drawings. However, the invention can be implemented by various modes and it is to be understood that various changes and modifications will be apparent to those skilled in the art. Unless such changes and modifications depart from the spirit and the scope of the invention, they should be construed as being included therein. Therefore, the invention is not limited to the description of embodiment modes and an embodiment. Note that throughout the diagrams for showing embodiment modes and an embodiment, the same portions or portions having the same function are denoted by the same reference numerals and repetitive description is omitted.

[Embodiment Mode 1]

FIG. 1A shows a block diagram of a display device in this embodiment mode, and detailed description will be made below. Note that a display device in the invention means a device having display elements (e.g., liquid crystal elements or light-emitting elements). The display device in the invention may be a display panel itself where a plurality of pixels including display elements such as liquid crystal elements or EL elements and a peripheral driver circuit for driving the pixels are formed over the same substrate. Further, the display device in the invention may include a display panel attached with a flexible printed circuit (FPC) or a printed wiring board (PWB). In addition, a light-emitting device means particularly a display device having self-luminous display elements such as EL elements or elements used for an FED. A liquid crystal display device means a display device having liquid crystal elements.

Note that in the invention, description "being connected" is synonymous with description "being electrically connected". Accordingly, in configurations disclosed in the invention, another element which enables an electrical connection (e.g., a switch, a transistor, a capacitor, an inductor, a resistor, or a diode) may be interposed between elements having a predetermined connecting relation.

FIG. 1A shows a basic configuration of the invention. A display device shown in FIG. 1A includes a gate signal line driver circuit 101, a source signal line driver circuit 102, a pixel portion 103, a phase comparator 110 (also described as a first circuit), a counter circuit 111 (also described as a second circuit), and a phase shift circuit 112 (also described as a third circuit). A gate line 107 (also described as a first signal line) is connected to the gate signal line driver circuit 101 and a source line 108 (also described as a second signal line) is connected to the source signal line driver circuit 102. A pixel 109 in the pixel portion 103 is connected to the gate line 107 and the source line 108. Then, in the pixel 109, a transistor for writing a signal from the source line 108 into a display medium provided in the pixel by a signal of the gate line 107 is provided. Respective terminals of the transistor are connected to the gate line 107 and the source line 108 in each pixel.

Figure 1B:
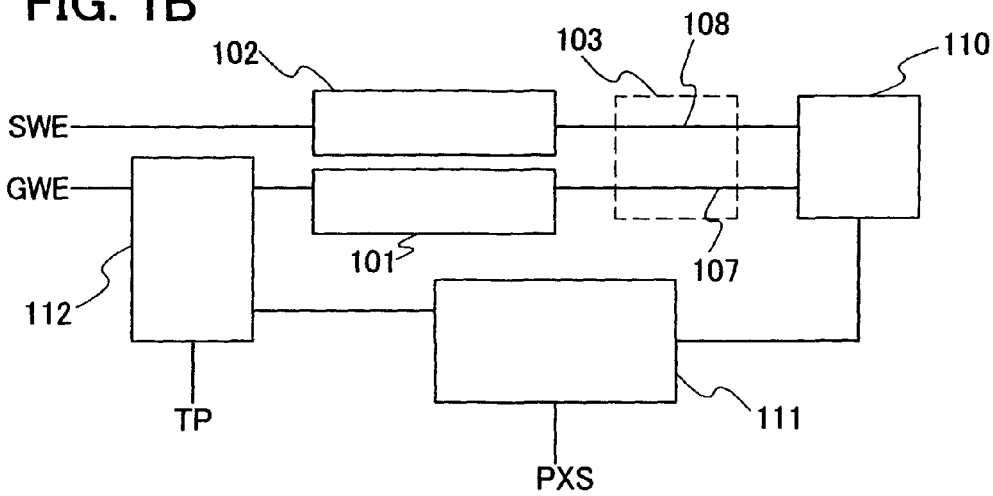

FIG. 1B is a diagram showing a signal input into each circuit by simplifying the block diagram shown in FIG. 1A. In FIG. 1B, the gate signal line driver circuit 101 is controlled by a gate signal writing control signal GWE which is input through the phase shift circuit 112, and the source signal line driver circuit 102 is controlled by a source signal writing control signal SWE. A scan signal (also described as a gate signal) is supplied from the gate signal line driver circuit 101 to the gate line 107, and an image signal (also described as a source signal or a video signal) is supplied from the source signal line driver circuit 102 to the source line 108. In the pixel portion 103, the phase comparator 110 is connected to a pair of the gate line 107 and the source line 108 and compares a phase of a signal input into the gate line 107 with a phase of a signal input into the source signal line 108. Then, an output signal from the phase comparator 110 is input into an input terminal of the counter circuit 111 through a wiring. An initial set signal PXS is input into the counter circuit 111 in addition to the signal from the phase comparator 110. Then, a signal in accordance with the number of signals which are counted in the counter circuit 111 is input from an output terminal of the counter circuit 111 into an input terminal of the phase shift circuit 112. In the phase shift circuit 112, a phase of the gate signal writing control signal GWE is shifted in accordance with a timing signal TP, and the gate signal writing control signal GWE is output from an output terminal into the gate signal line driver circuit 101, so that a phase shift of the scan signal and the image signal is corrected.

Figure 2:
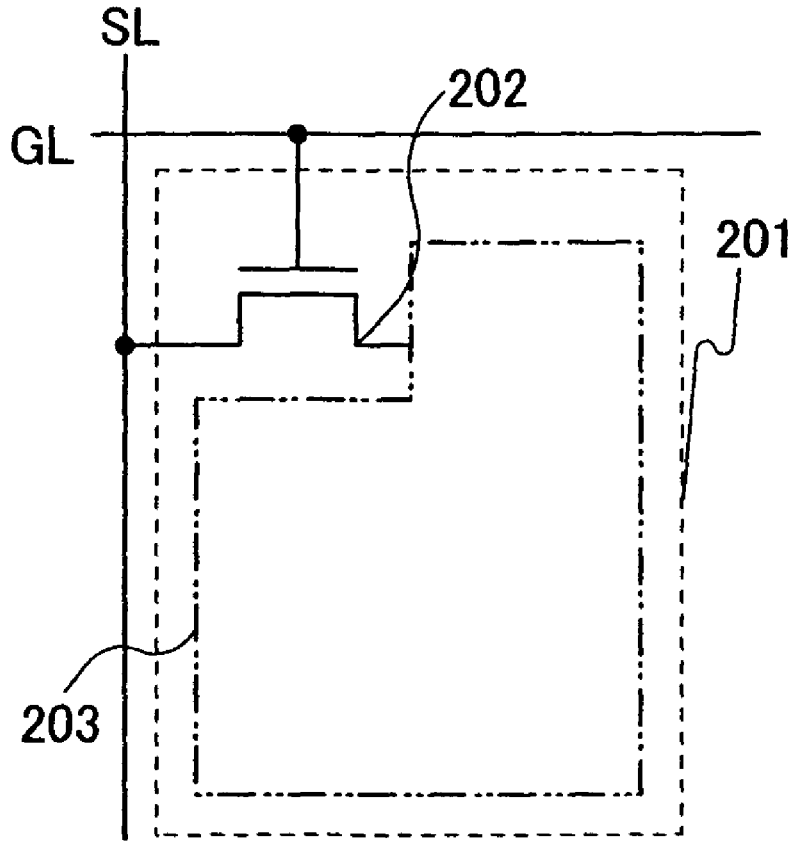
FIG. 2 is an explanatory diagram of a pixel in a display device to which the invention is applied.

In addition, a specific example of a pixel configuration in the pixel 109 is given in FIG. 2. FIG. 2 includes a pixel 201, a transistor 202, and a display medium 203. In this embodiment mode, an N-channel transistor is used for the transistor 202 for writing of a signal from a source line SL (also described as a writing transistor). Accordingly, when a gate line GL becomes a High level, the transistor 202 is turned on so that a potential of the source line SL is taken in the display medium 203. Alternatively, when the gate line GL becomes a Low level, the transistor 202 is turned off so that the potential of the source line SL is not reflected in the display medium 203.

As a display medium in a display device of the invention, a display device which performs display by using signals input into a gate line and a source line such as a liquid-crystal display device, a DMD (Digital Micromirror Device), a PDP (Plasma Display Panel), or an FED (Field Emission Display) is included in its category, in addition to a display device provided with a light-emitting element typified by an organic light-emitting element and an inorganic element in each pixel.

Note that a thin film transistor using a polycrystalline semiconductor, a microcrystalline semiconductor (including a semi-amorphous semiconductor), or an amorphous semiconductor can be used as a transistor used in the display device of the invention; however, the transistor used in the display device of the invention is not limited to a thin film transistor. A transistor using single crystalline silicon or a transistor employing an SOI may be used. Alternatively, a transistor using an organic semiconductor, a transistor using a carbon nanotube, or a transistor using zinc oxide may be used. Further, a transistor provided in a pixel of the display device of the invention may have a single-gate structure, a double-gate structure, or a multi-gate structure having two or more gates.

Figure 3A:
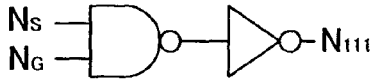
FIG. 3A is a diagram showing an example of a phase comparator of the invention.
Figure 22A:
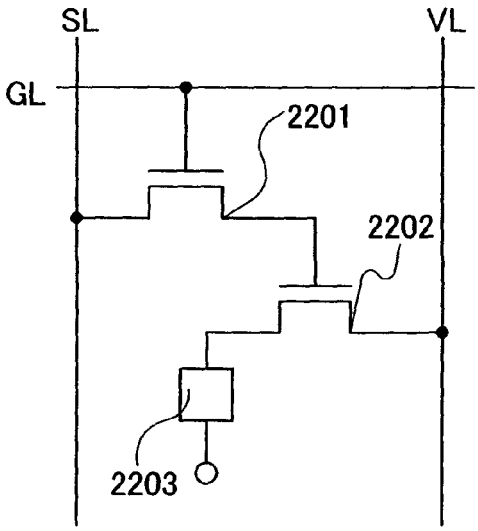
FIG. 22A is a diagram showing a conventional example.
Figure 22B:
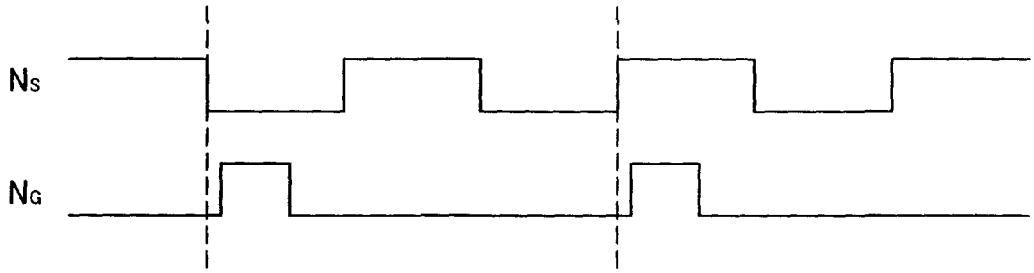
FIGS. 22B and 22C are timing charts showing conventional examples.
Figure 22C:
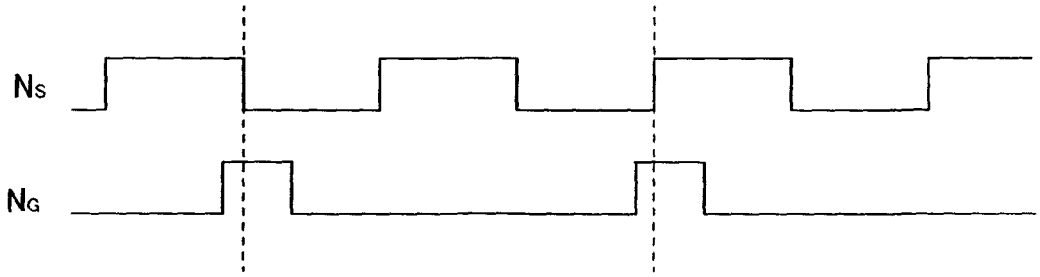

Next, a function and a configuration of the phase comparator 110 in this embodiment mode are described in FIG. 3A. In this embodiment mode, as in FIG. 22C which is described above, when a signal for lighting the pixel is input into the pixel, a potential in which a potential of the node $N_G$ in the gate line is at a High level and a signal of the node $N_S$ in the source line is lowered to be at a Low level is taken in the pixel. In the phase comparator 110, an AND of the signal of the node $N_S$ in the source line and a signal of the node $N_G$ in the gate line is obtained. Specifically, a NAND by a NAND circuit is obtained as shown in FIG. 4A, and then, the NAND is inverted by an inverter circuit so that it is output into a node $N_{111}$ on a counter circuit 111 side.

Figure 3B:
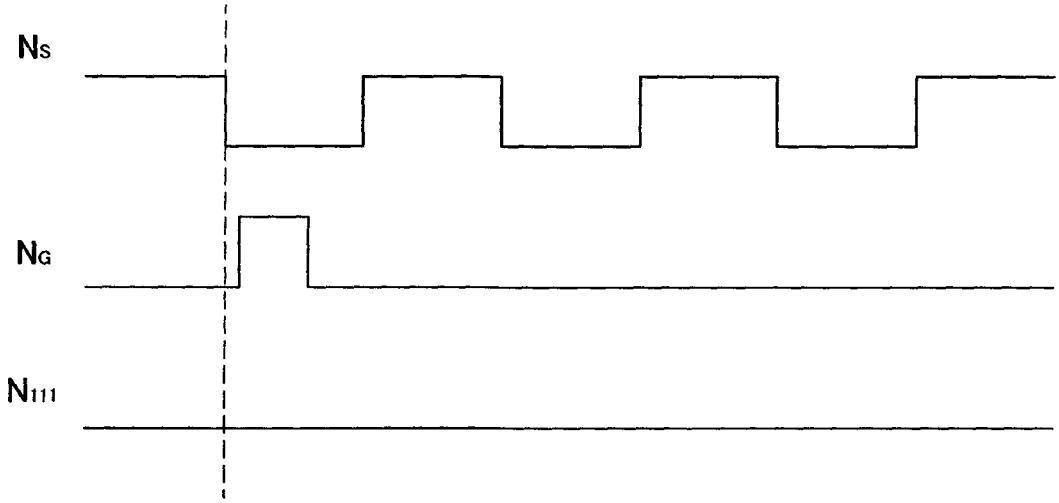
FIGS. 3B and 3C are timing charts showing examples of a phase comparator of the invention.
Figure 3C:
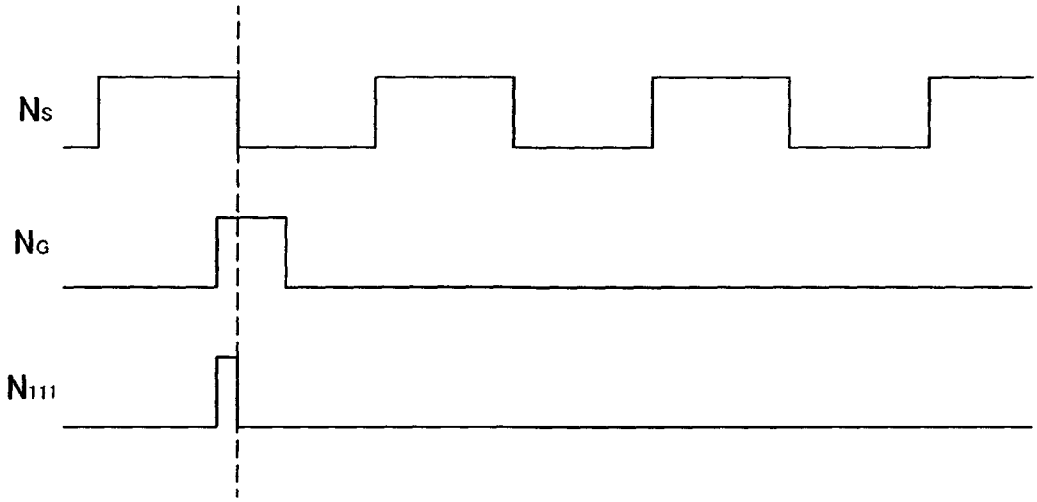

FIG. 3B shows the case where a signal of the source line and a signal of the gate line are normal signals in the circuit in FIG. 3A. In addition, FIG. 3C shows the case where a phase of the signal of the source line and a phase of the signal of the gate line are shifted and not the normal signals in the circuit in FIG. 3A. The node $N_{111}$ on the counter circuit 111 side outputs a Low level in FIG. 3B, whereas the node $N_{111}$ on the counter circuit 111 side outputs a High-level signal in accordance with the phase shift in FIG. 3C.

In addition, the phase comparator 110 is not limited to the configuration shown in FIG. 3A. FIG. 4A shows another configuration of the phase comparator 110. In the configuration in FIG. 4A, when the signal for lighting the pixel is input into the pixel, a potential in which a potential of the node $N_G$ in the gate line is at a High level and a potential of the node $N_S$ in the source line is raised to be at a High level is taken in the pixel, which is different from the configuration shown in FIG. 3A. In the phase comparator 110, an OR of an inverted signal of the signal of the node $N_S$ in the source line and an inverted signal of the signal of the node $N_G$ in the gate line is obtained. Specifically, the signal of the node $N_G$ in the gate line is inverted by the inverter circuit as shown in FIG. 4A and the signal of the node $N_S$ in the source line is input into a NOR circuit, so that they are output into the node $N_{111}$ on the counter circuit 111 side.

Figure 4A:
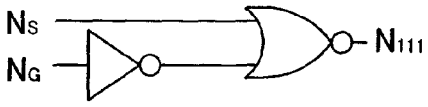
FIG. 4A is a diagram showing an example of a phase comparator of the invention.
Figure 4B:
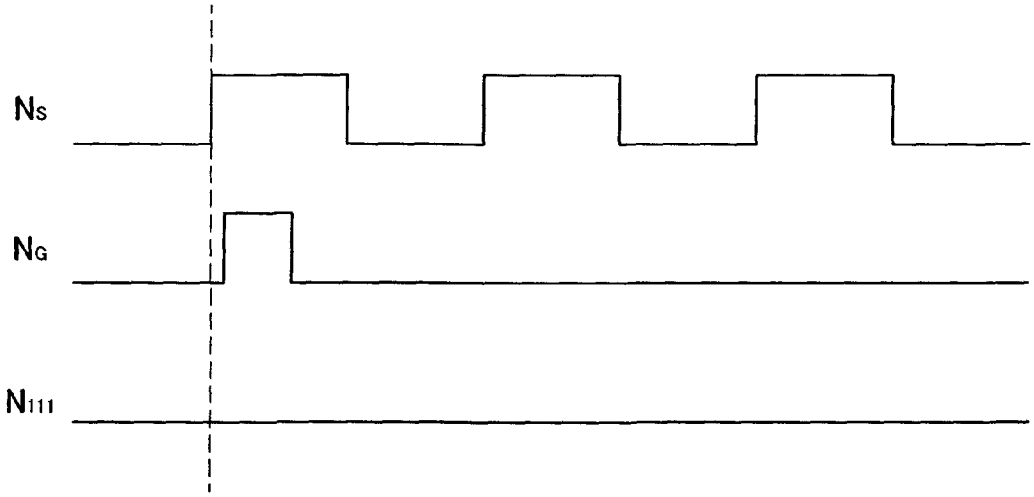
FIGS. 4B and 4C are timing charts showing examples of a phase comparator of the invention.
Figure 4C:
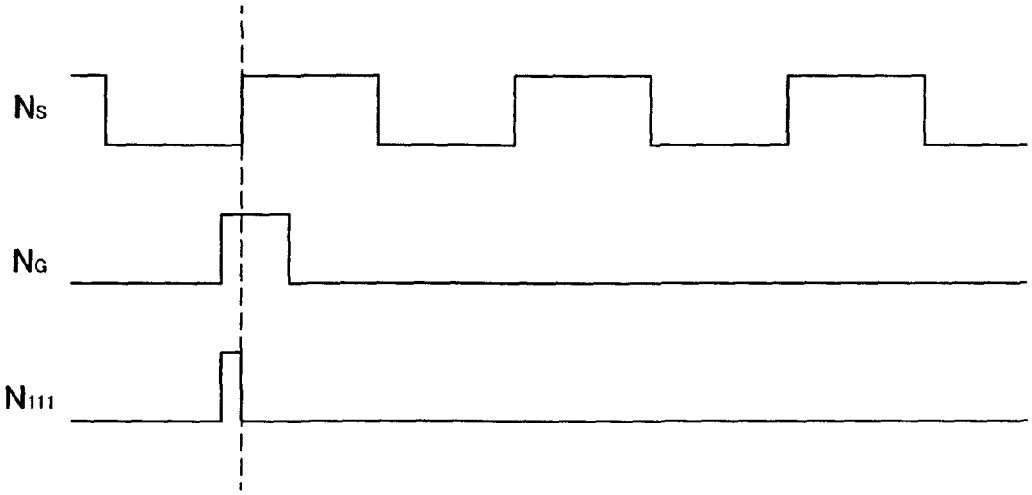

FIG. 4B shows the case where the signal of the source line and the signal of the gate line are normal signals in the circuit in FIG. 4A. In addition, FIG. 4C shows the case where the phase of the signal of the gate line is shifted from the phase of the signal of the source line so that a normal phase relationship is not provided in the circuit in FIG. 4A. The node $N_{111}$ on the counter circuit 111 side outputs a Low-level signal in FIG. 4B, whereas the node $N_{111}$ on the counter circuit 111 side outputs a High-level signal in accordance with the phase shift in FIG. 4C.

Next, a function and a configuration of the counter circuit 111 in this embodiment mode are described. In this embodiment mode, the output signal from the phase comparator 110 shown in FIG. 3A is counted by a counter using a delay-type flip-flop circuit (hereinafter described as a D flip-flop circuit) shown in FIG. 5. The initial set signal PXS for initializing is input into the D flip-flop circuit in FIG. 5. In addition, the D flip-flop circuit in this embodiment mode includes a configuration having two stages, and output signals are output from terminals C0, C1, C2, and C3. Note that a signal output from the D flip-flop circuit in a first stage goes through a node $N_{B1}$ and a signal output from the D flip-flop circuit in a second stage goes through a node $N_{B2}$, and the signals which go through the node $N_{B1}$ and the node $N_{B2}$ are counted by a logic circuit so that they are output from the terminals C0, C1, C2, and C3.

Note that a logic circuit in this specification means a circuit combined with transistors such as an AND circuit or an OR circuit. In addition, as a transistor in this specification, a thin film transistor (TFT), a transistor formed by using a semiconductor substrate or an SOI substrate, a MOS transistor, a junction transistor, a bipolar transistor, a transistor using a compound semiconductor such as ZnO or a-InGaZnO, a transistor using an organic semiconductor or a carbon nanotube, or other transistors can be applied. Further, a type of a substrate over which a transistor is arranged is not limited to a certain type, so that various types of substrates can be used. Accordingly, for example, the transistor can be formed over a single crystalline substrate, an SOI substrate, a glass substrate, a plastic substrate, a paper substrate, a cellophane substrate, a quartz substrate, or the like. Further, the transistor may be formed over a substrate, and then, the transistor may be moved over another substrate so that it is arranged over another substrate.

Figure 6:
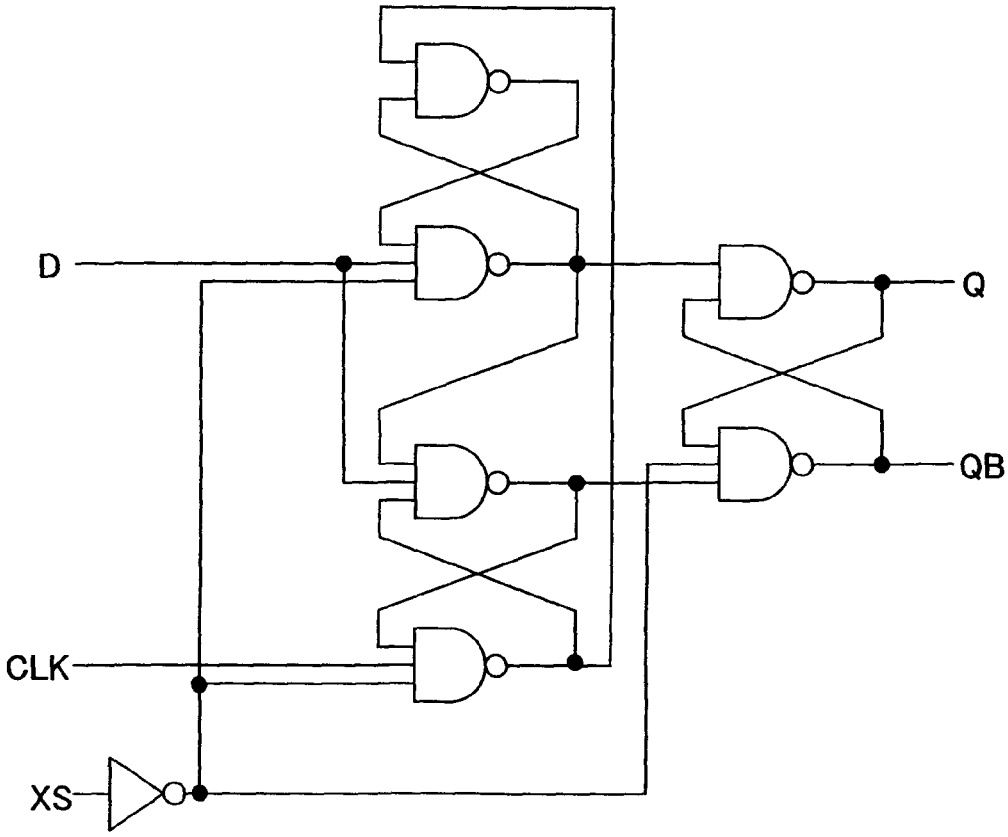
FIG. 6 is a circuit diagram showing an example of a D flip-flop circuit of the invention.

FIG. 6 shows an example of the D flip-flop circuit in the counter circuit which is used in this embodiment mode. The D flip-flop circuit illustrated in this embodiment mode is formed as an NAND circuit and used as a counter; however, another circuit may be used as long as it has a function as a counter. In addition, in the counter circuit, the number of stages and the number of output terminals of the D flip-flop circuit may be increased. For example, the D flip-flop circuit is formed to have three stages and eight output terminals, so that the phase shift of the signal input into the pixel can be exactly corrected in the phase shift circuit.

Figure 5:
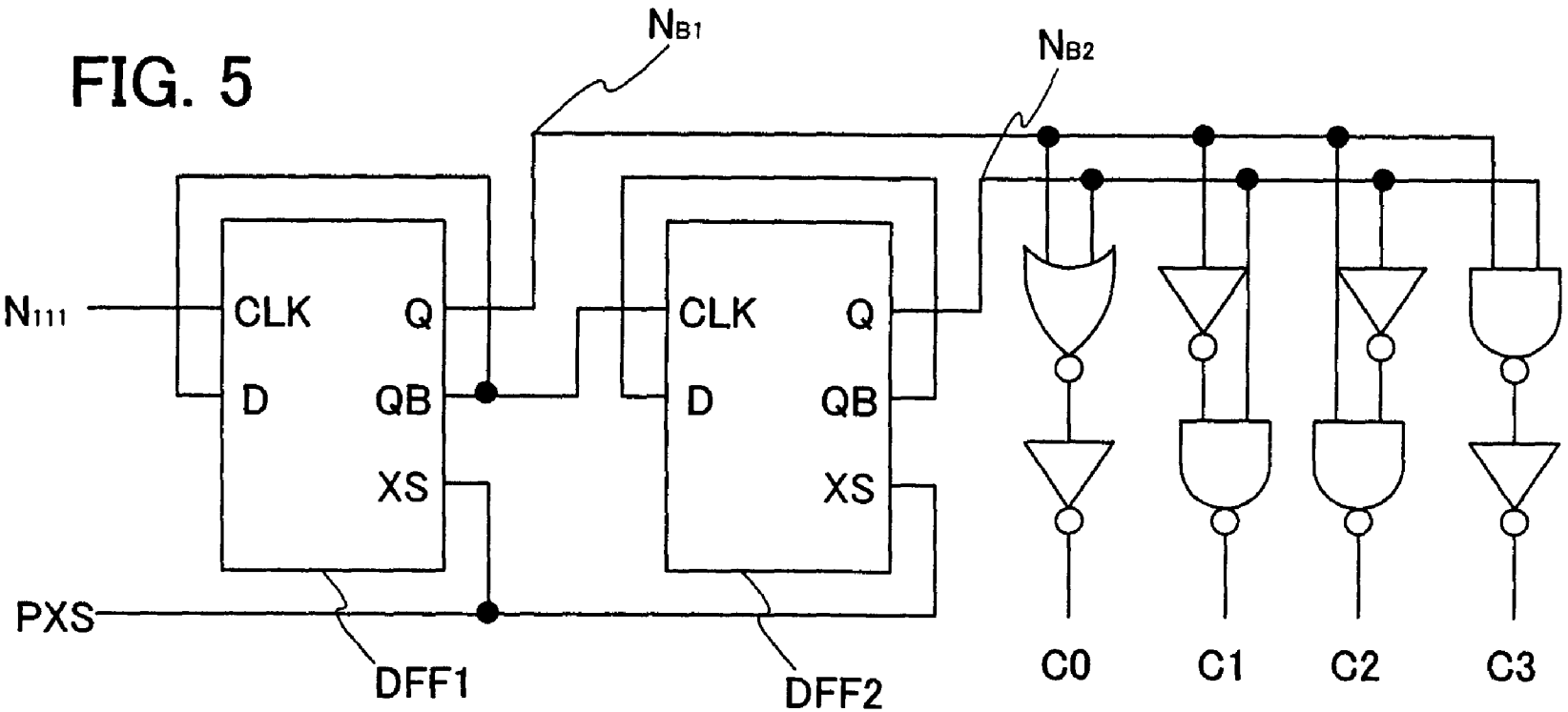
FIG. 5 is a diagram showing an example of a counter circuit of the invention.
Figure 7:
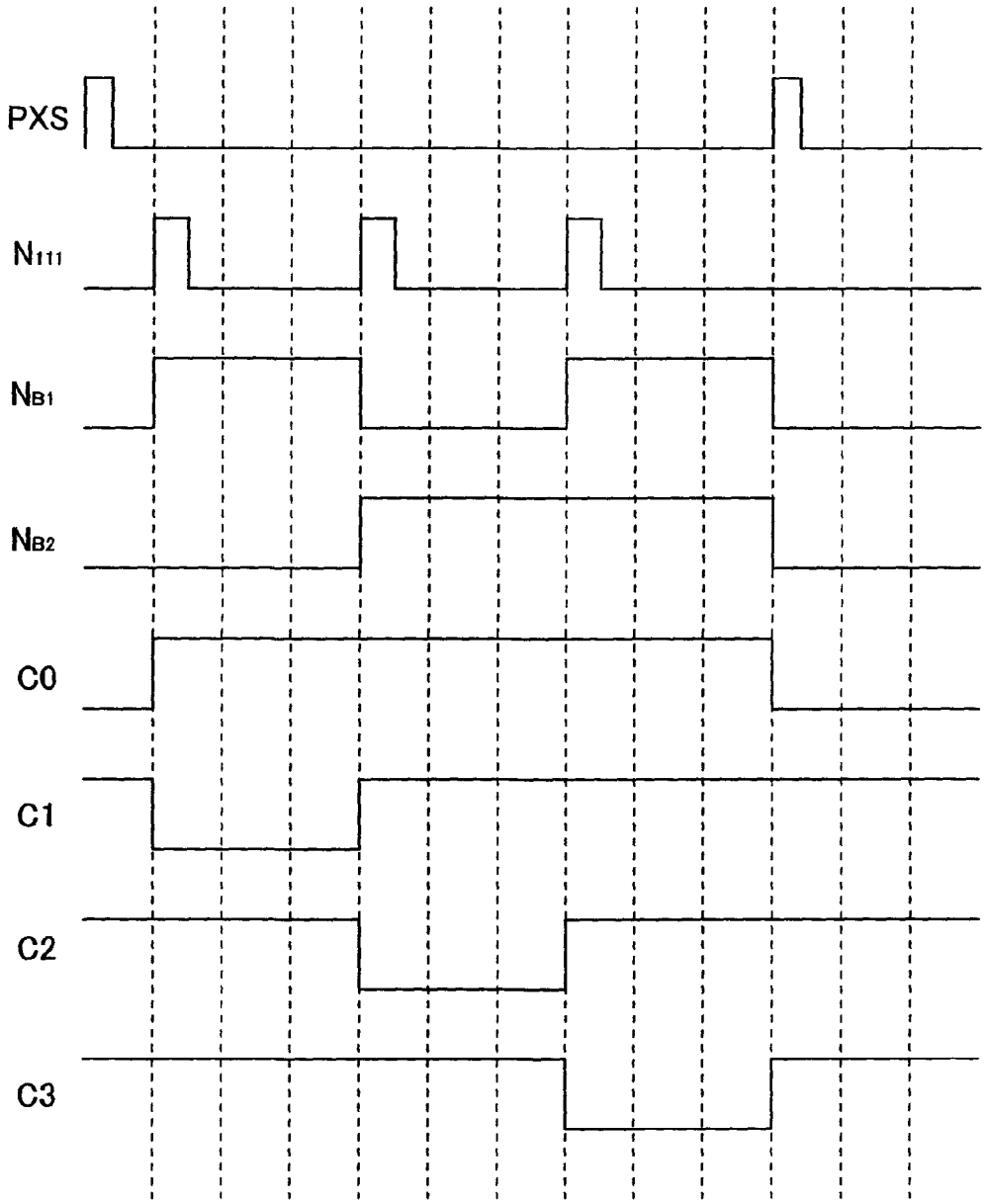
FIG. 7 is a timing chart showing an operation of a counter circuit of the invention.

In addition, FIG. 7 shows a timing chart of the counter circuit shown in FIG. 5. The initial set signal PXS is input into the counter circuit 111 only once before the operation of the phase comparator 110 is started. Since this initial set signal PXS is input into the counter circuit 110, an output signal from the terminal C0 in the counter circuit becomes a Low level and output signals from the terminals C1, C2, and C3 becomes a High level. The, potentials of the node $N_{B1}$ and the node $N_{B2}$ are changed in the case where a potential of the node $N_{111}$ which is an output signal from the phase comparator 110 is at a High level. Accordingly, every time a phase shift is detected, a Low-level potential in the terminal C0 is shifted in the terminals C1, C2, and C3 so that the aforementioned phase shift can be counted.

Next, a function and a configuration of the phase shift circuit 112 in this embodiment mode are described. In this embodiment mode, the phase of the gate signal writing control signal GWE is shifted in the phase shift circuit 112 in FIG. 8 based on an output signal from the counter circuit 111 shown in FIG. 7. In the case where the gate signal writing control signal GWE is not shifted, a wiring into which the gate signal writing control signal GWE is input is directly connected to an analog switch, and the analog switch is turned on by a signal from the terminal C0 so that it directly outputs the gate signal writing control signal GWE. The phase shift circuit 112 shown in FIG. 8 has a configuration in which there are as many flip-flop circuits as output signals from the counter circuit 111. Each stage of the flip-flop circuit is connected to the gate signal line driver circuit 101 in FIGS. 1A and 1B through an analog switch provided in each stage. Then, each analog switch is connected to the terminals C1, C2, and C3 into which signals from the counter circuit 111 are output.

Figure 8:
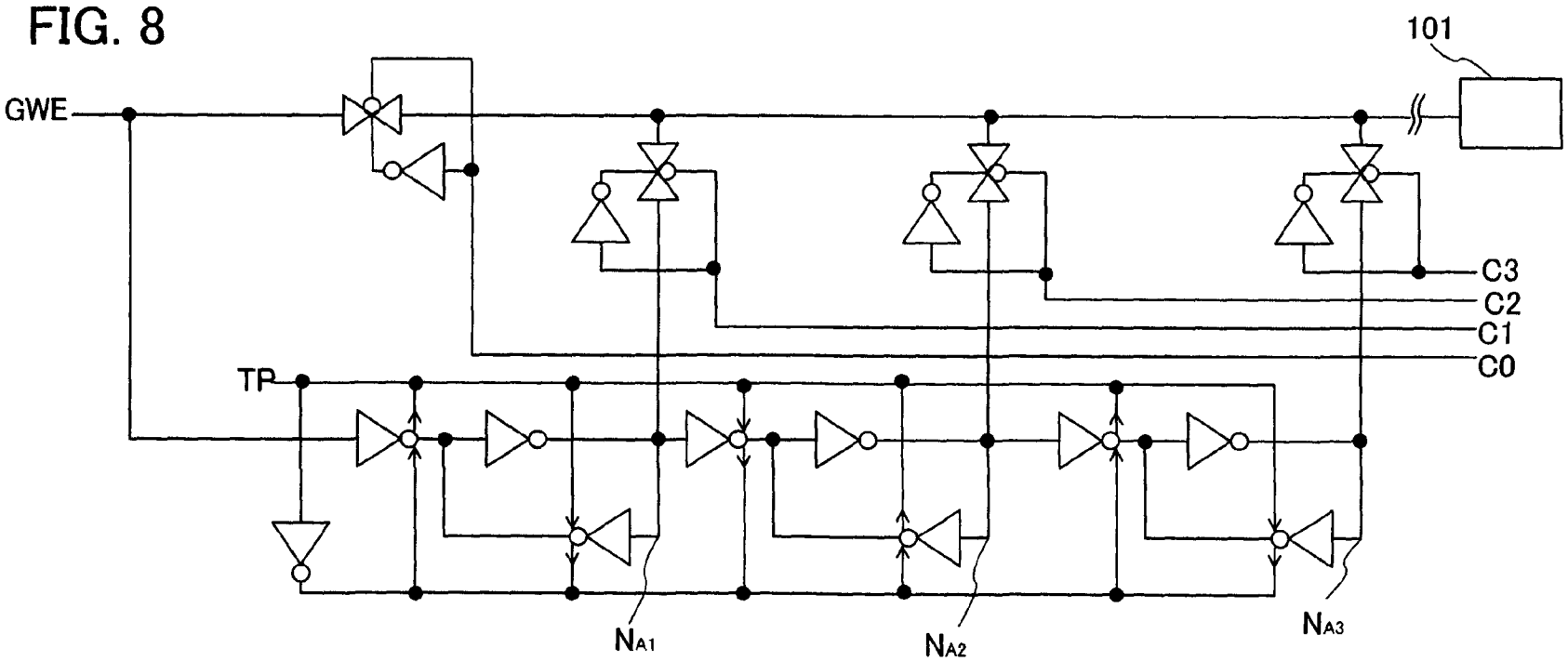
FIG. 8 is a diagram showing an example of a phase shift circuit of the invention.
Figure 9:
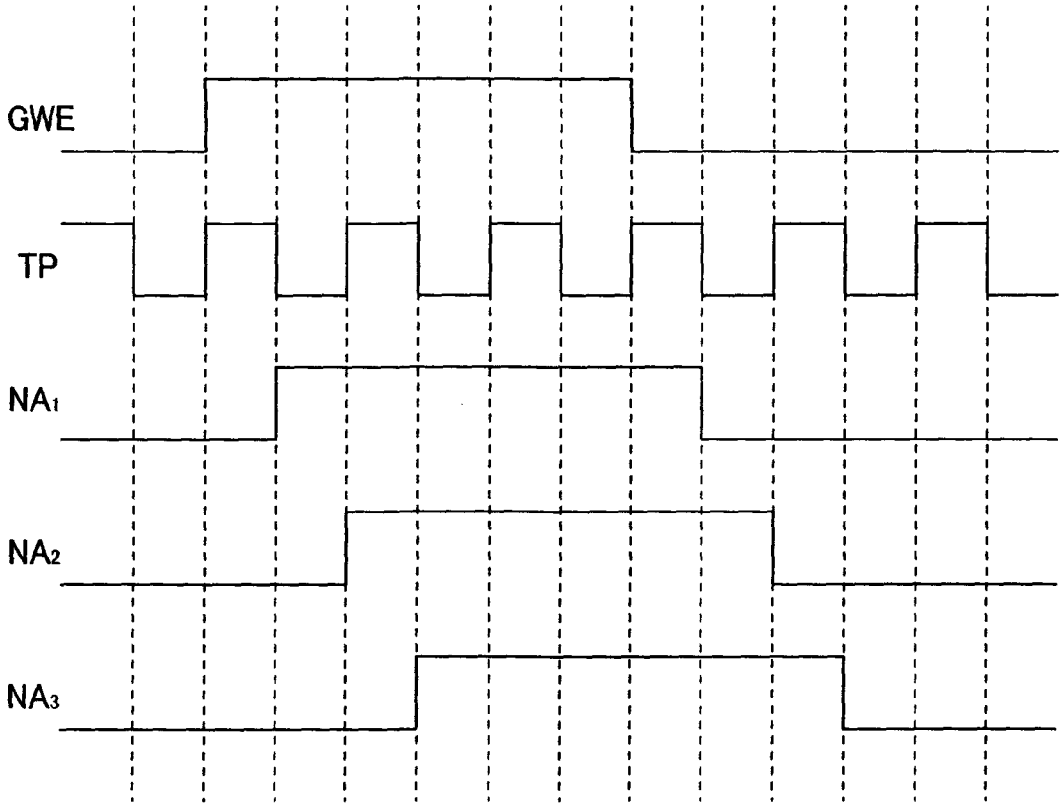
FIG. 9 is a timing chart showing an operation of a phase shift circuit of the invention.

In addition, FIG. 9 shows a timing chart of the phase shift circuit 112 shown in FIG. 8. In the gate signal writing control signal GWE input into the phase shift circuit 112, its High-level period is shifted with the flip-flop circuit by half of a wavelength of the timing signal TP, and the gate signal writing control signal GWE input into the phase shift circuit 112 is output from a node $N_{A1}$, a node $N_{A2}$, and a node $N_{A3}$.

By employing the configuration in this embodiment mode, particularly in the case of driving by using a digital driving method in an active matrix display device, phase shifts of signals are counted and restored inside the display device so that normal display can be obtained, even when phases of a scan signal and an image signal input into a pixel portion are shifted by dullness or delay of the signals caused by resistance, a capacitance component, or the like of the wiring to which the signals are supplied.

Note that the configuration of each circuit in this embodiment mode is just an example, so that the invention is not limited to this. That is, in the aforementioned phase comparator, any circuit may be employed as long as it can detect a phase shift of signals supplied to two wirings which are connected and output the signals. In addition, in the aforementioned counter circuit, any circuit may be employed as long as it counts the phase shifts detected by the phase comparator and outputs a signal in accordance with the number of counts. Further, in the aforementioned phase shift circuit, any circuit may be employed as long as it shifts a phase of one of the signals supplied to the two wirings which are connected based on the number of the counts in the counter circuit.

Note that this embodiment mode can be combined with another embodiment mode in this specification as appropriate and implemented.

[Embodiment Mode 2]

In this embodiment mode, a configuration which is different from the configuration shown in Embodiment Mode 1 is described.

First, a driving method of a display device in this embodiment mode is described with reference to FIGS. 10A and 10B, FIG. 11, and FIG. 12.

Figure 10A:
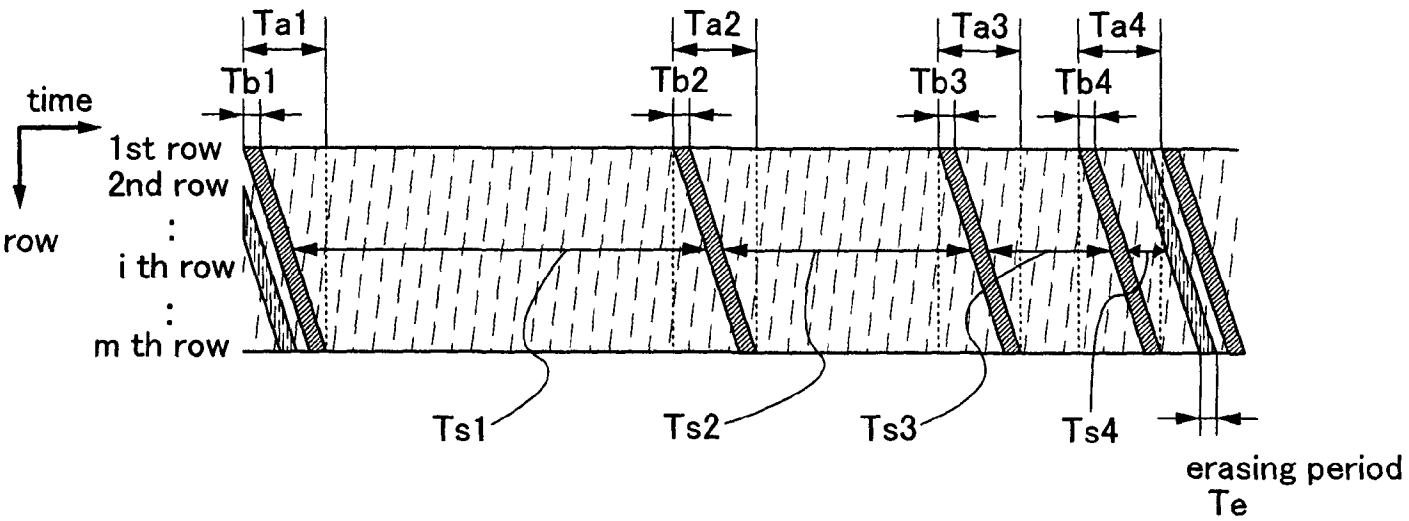
FIGS. 10A and 10B are diagrams showing Embodiment Mode 2 of the invention.
Figure 10B:
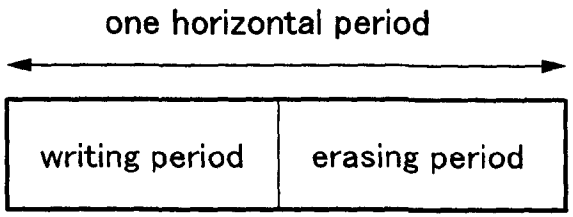

In the time gray scale method which is one of the methods for expressing gray scales by the digital gray scale method, there is a driving method in which row writing periods are divided into two, and writing of a video signal into a pixel is performed in a first half of the row writing period (also described as a first row writing period) and writing a signal for erasing the video signal written into the pixel into the pixel is performed in a second half of the row writing period (also described as a second row writing period). A non-displaying period is provided by performing writing of the signal for erasing the video signal written into the pixel into the pixel, and length of a subframe period is made shorter than length of a writing period. FIGS. 10A and 10B show such a driving method.

FIGS. 10A and 10 B are described. In an address period Ta1, a scan signal is input into the gate signal line sequentially from a first row so that the pixel is selected. When the pixel is selected, a video signal is input from the source signal line into the pixel. Then, when the video signal is input into the pixel, the pixel holds the signal until another signal is input.

Lighting and non-lighting of each signal in a sustain period Ts1 are controlled by this written video signal. That is, in a row in which an operation of writing of the video signal is completed, the pixel immediately becomes to be in a lighting state or a non-lighting state in accordance with the written video signal. The same operation is performed up to the last row and the address period Ta1 is terminated. Then, the row where a data holding period is terminated sequentially starts a signal writing operation of the next subframe period. Similarly in address periods Ta2, Ta3, and Ta4, a video signal is input into the pixel and lighting and non-lighting of each pixel in sustain periods Ts2, Ts3, and Ts4 are controlled by the video signal. In addition, a period of the sustain period Ts4 is set by a start of an erasing operation. This is because when erasing of the signal written into the pixel is performed in an erasing period Te in each row, the pixel forcibly becomes non-lighting until writing of a signal into the next pixel is performed regardless of the video signal written into the pixel in the address period. That is, the data holding period is terminated from a pixel of a row where the erasing period Te is started.

Accordingly, a display device with a high-level gray scale and a high duty ratio (a ratio of a lighting period in one frame period) in which a data holding period is shorter than an address period without separating the address period from a sustain period can be provided. In addition, since instantaneous luminance can be lowered, reliability of a display element can be improved. As shown in FIG. 10B, a writing period for a writing operation and an erasing period for the erasing operation are provided in one horizontal period, so that a gray scale in the case where the data holding period is shorter than the address period as shown in FIG. 10A can be expressed.

Figure 11:
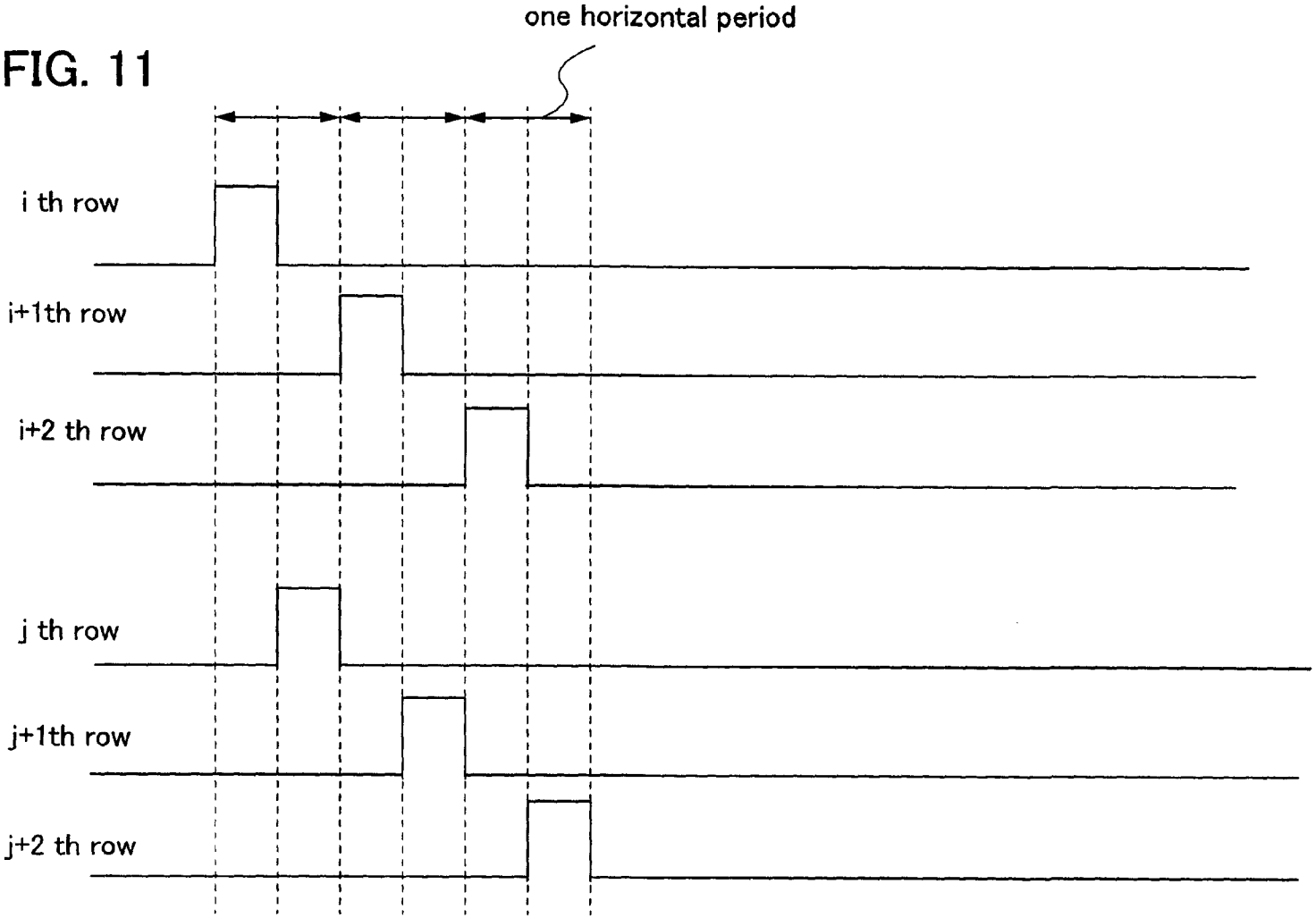
FIG. 11 is a timing chart showing Embodiment Mode 2 of the invention.

For example, as shown in FIG. 11, the one horizontal period is divided into two. Here, the case where a first half of the one horizontal period is the writing period and a second half thereof is the erasing period is described. Then, in the divided horizontal period, each scan line is selected and a corresponding signal at that time is input into the source signal line. For example, an i-th row is selected in a first half of a certain horizontal period and a j-th row is selected in a second half thereof. Then, an operation can be performed as if two rows are selected at the same time in the one horizontal period. That is, video signals are written from the source signal lines into pixels in writing periods Tb1 to Tb4 by using the first half of the writing period in each one horizontal period. The pixel is not selected in the second half of the erasing period in the one horizontal period at this time. In addition, erasing signals are input from the source signal line into the pixels in the erasing period Te by using a second half of an erasing period in another one horizontal period. The pixel is not selected in the first half of the writing period in the one horizontal period at this time. In this manner, a display device including a pixel which has a high aperture ratio can be provided, and thus, a yield can be improved.

Figure 12:
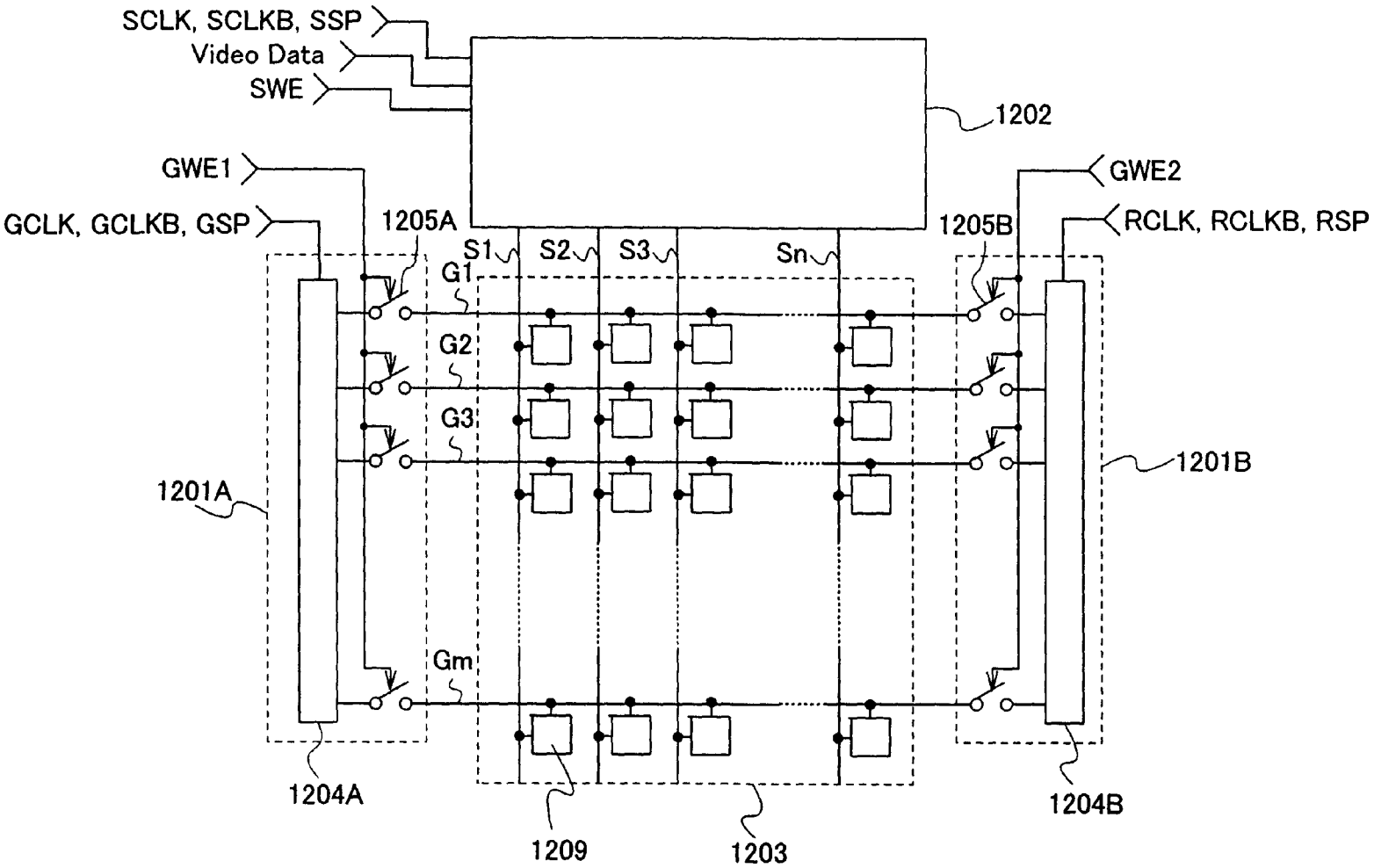
FIG. 12 is a diagram showing Embodiment Mode 2 of the invention.

Further, FIG. 12 shows an example of a display device employing the aforementioned driving.

The display device includes a first gate signal line driver circuit 1201A, a second gate signal line driver circuit 1201B, a source signal line driver circuit 1202, and a pixel portion 1203. In the pixel portion 1203, pixels 1209 are arranged in matrix corresponding to gate signal lines G1 to Gm and source signal lines S1 to Sn. The first gate signal line driver circuit 1201A includes a shift register circuit 1204A and a switch 1205A which controls an electrical connection state or a disconnection state of the shift register circuit 1204A and each of the gate signal lines G1 to Gm. In addition, the second gate signal line driver circuit 1201B includes a shift register circuit 1204B and a switch 1205B which controls an electrical connection state or a disconnection state the shift register circuit 1204B and each of the gate signal lines G1 to Gm.

Note that a gate signal line Gp (one of the gate signal lines G1 to Gm) corresponds to the gate signal line 107 in FIGS. 1A and 1B, and a source signal line Sq (one of the source signal lines S1 to Sn) corresponds to the source signal line 108 in FIGS. 1A and 1B.

A clock signal (GCLK), a clock inverted signal (GCLKB), a start pulse signal (GSP), a first gate signal writing control signal (GWE1), and the like are input into the first gate signal line driver circuit 1201A. In accordance with these signals, a signal for selecting a pixel is output into a first gate signal line Gp (one of the gate signal lines G1 to Gm) in a pixel row which is selected. Note that the signal at this time corresponds to a pulse output in the first half of the one horizontal period as shown in the timing chart in FIG. 11. That is, the signal output from the shift register circuit 1204A is output into the gate signal lines G1 to Gm only when the switch 1205A is on.

A clock signal (RCLK), a clock inverted signal (RCLKB), a start pulse signal (RSP), a second gate signal writing control signal (GWE2), and the like are input into the second gate signal line driver circuit 1201B. In accordance with these signals, a signal for selecting a pixel is output into a second gate signal line Gq (one of the gate signal lines G1 to Gm) in a pixel row which is selected. Note that the signal at this time corresponds to a pulse output in the second half of the one horizontal period as shown in the timing chart in FIG. 11. That is, the signal output from the shift register circuit 1204B is output into the gate signal lines G1 to Gm only when the switch 1205B is on.

In addition, a clock signal (SCLK), a clock inverted signal (SCLKB), a start pulse (SSP), a video signal (Video Data), a source signal writing control signal (SWE), and the like are input into the source signal line driver circuit 1202. Then, in accordance with these signals, the source signal line driver circuit 1202 outputs signals corresponding to pixels in each column into each of the source signal lines S1 to Sn. Signals output from the source signal line driver circuit 1202 are controlled by the source signal writing control signal (SWE). That is, the video signal is output when the source signal writing control signal (SWE) is at a Low level, and an erasing signal is output when the source signal writing control signal (SWE) is at a High level.

Accordingly, the video signals input into the source signal lines S1 to Sn are written into the pixels 1209 in each column of pixel rows which are selected by a signal input from the first gate signal line driver circuit 1201A into a gate signal line Gi (one of the gate signal lines G1 to Gm). Then, each pixel row is selected by each of the gate signal lines G1 to Gm, and a video signal corresponding to each pixel is written into each of the pixels 1209. Each of the pixels 1209 holds data of the written video signal for a certain period. Therefore, each of the pixels 1209 can hold its lighting state or non-lighting state.

Figure 13A:
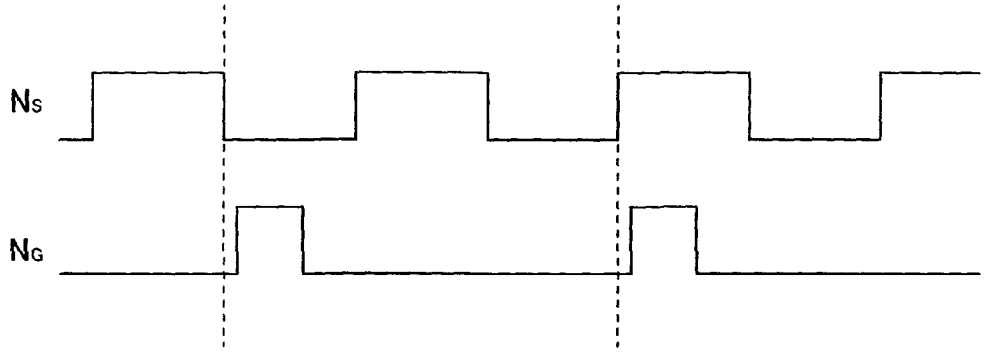
FIGS. 13A to 13D are timing charts showing Embodiment Mode 2 of the invention.
Figure 13B:
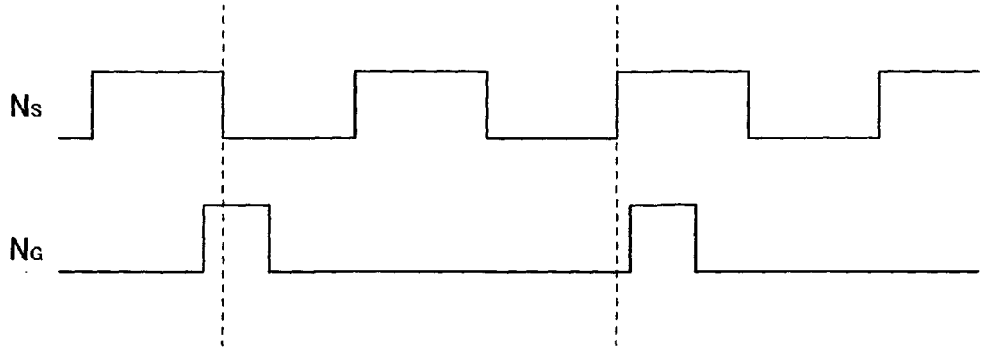
Figure 13C:
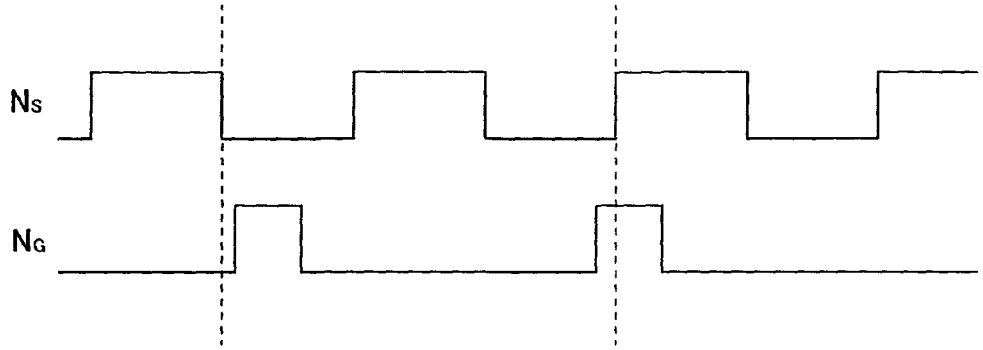
Figure 13D:
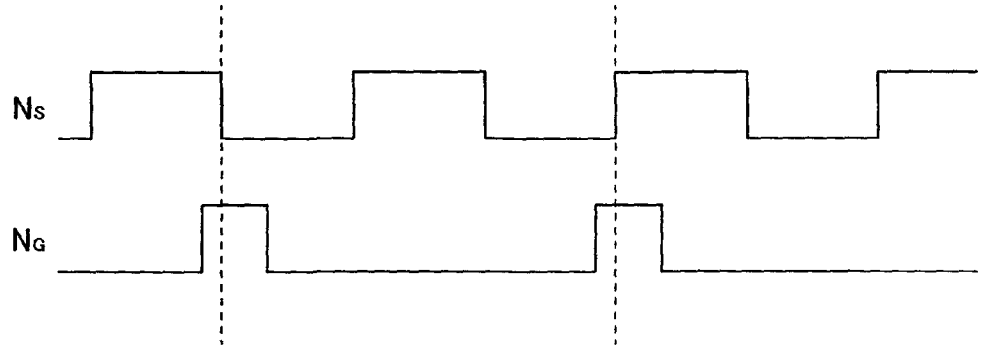

In the driving methods shown in FIGS. 10A and 10B, 11, and 12, the gate signal lines perform scanning for writing video data and scanning for erasing the video data in one horizontal period. Then, as shown in FIG. 13A, it is necessary that scanning for writing video data and scanning for erasing the video data have a normal phase relationship with the source signal. However, as shown in FIGS. 13B and 13C, it is possible that the normal phase relationship and a defective phase relationship coexist in the one horizontal period. In addition, as shown in FIG. 13D, it is possible that both of scanning for writing the video data and scanning for erasing the video data be in states where phases are shifted in the one horizontal period.

Thus, in this embodiment mode, a display device is described, which detects a phase shift even when such writing and erasing of the video signal are performed by the same gate signal line in the one horizontal period, counts the shift, and shifts the phase so that it can be corrected into a normal phase.

Figure 14A:
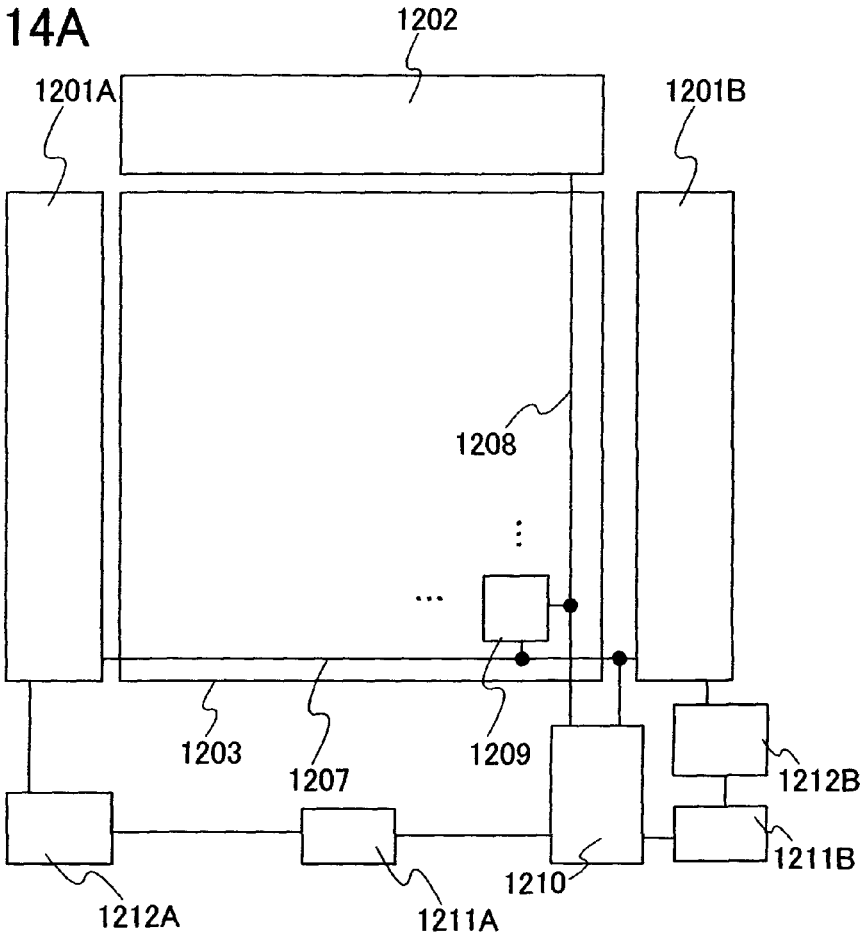
FIGS. 14A and 14B are diagrams for showing a configuration of a phase comparator in Embodiment Mode 2 of the invention.

FIG. 14A shows a block diagram of a display device in this embodiment mode, and detailed description will be made below. Note that the block diagram shown in FIG. 14A is a diagram by simplifying the display device shown in FIG. 12 and the same reference numerals are used as reference numerals. Note that when specific examples of each configuration in this embodiment mode have similar configurations in Embodiment Mode 1, the description in Embodiment Mode 1 is applied thereto.

FIG. 14A shows a basic configuration of this embodiment mode. A display device shown in FIG. 14A includes the first gate signal line driver circuit 1201A, the second gate signal line driver circuit 1201B, the source signal line driver circuit 1202, the pixel portion 1203, a phase comparator 1210 (also described as a first circuit), a first counter circuit 1211A (also described as a second circuit), a second counter circuit 1211B, a first phase shift circuit 1212A (also described as a third circuit), and a second phase shift circuit 1212B. A gate line 1207 is connected to the first gate signal line driver circuit 1201A and the second gate signal line driver circuit 1201B and a source line 1208 is connected to the source signal line driver circuit 1202. A pixel 1209 in the pixel portion 1203 is connected to the gate line 1207 and the source line 1208. Then, in the pixel 1209, a transistor for writing a signal from the source line 1208 into a display medium provided in the pixel by a signal of the gate line 1207 is provided. Respective terminals of the transistor are connected to the gate line 1207 and the source line 1208 in each pixel.

Figure 14B:
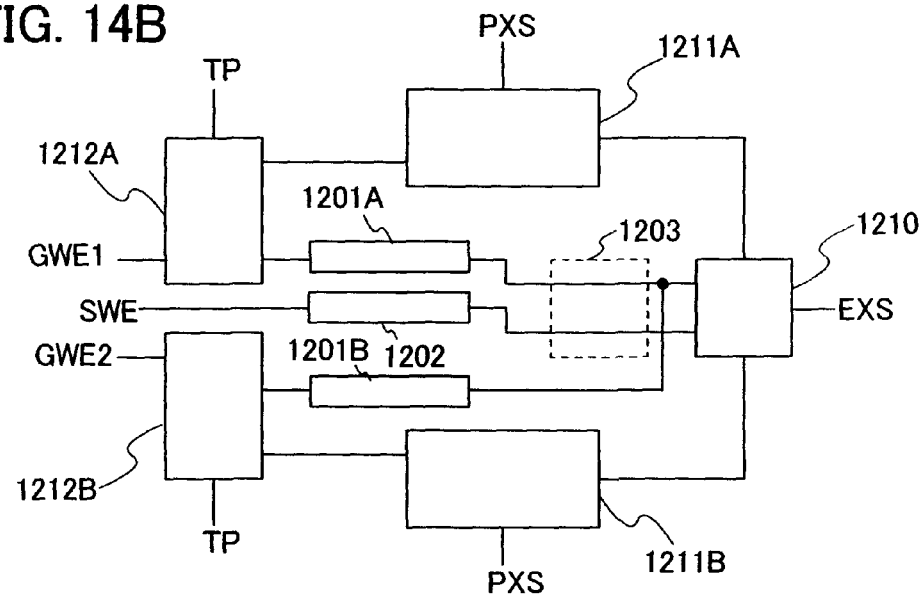

FIG. 14B is a diagram showing a signal input into each circuit by simplifying the block diagram shown in FIG. 14A. In FIG. 14B, the first gate signal line driver circuit 1201A is controlled by a first gate signal writing control signal GWE1 which is input through the first phase shift circuit 1212A, the second gate signal line driver circuit 1201B is controlled by a second gate signal writing control signal GWE2 which is input through the second phase shift circuit 1212B, and the source signal line driver circuit 1202 is controlled by the source signal writing control signal SWE. A first scan signal (also described as a writing signal) is supplied from the first gate signal line driver circuit 1201A to the gate line 1207, a second scan signal (also described as an erasing signal) is supplied from the second gate signal line driver circuit 1201B to the gate line 1207, and an image signal (also described as a source signal or a video signal) is supplied from the source signal line driver circuit 1202 to the source line 1208. In the pixel portion 1203, the phase comparator 1210 into which a set signal is input in every horizontal period is connected to a pair of the gate line 1207 and the source line 1208, and compares a phase of a signal input into the gate line 1207 with a phase of a signal input into the source line 1208. Then, output signals from the phase comparator 1210 are input into an input terminal of the first counter circuit 1211A and an input terminal of the second counter circuit 1211B through wirings. The initial set signal PXS is input into the first counter circuit 1211A and the second counter circuit 1211B in addition to the signal from the phase comparator 1210. Then, signals in accordance with the number of signals which are counted in the first counter circuit 1211A and the second counter circuit 1211B respectively are input from an output terminal of the first counter circuit 1211A and an output terminal of the second counter circuit 1211B into an input terminal of the first phase shift circuit 1212A and an input terminal of the second phase shift circuit 1212B. In the first phase shift circuit 1212A and the second phase shift circuit 1212B, a phase of the first gate signal writing control signal GWE1 and a phase of the second gate signal writing control signal GWE2 are shifted in accordance with the timing signal TP, and the first gate signal writing control signal GWE1 and the second gate signal writing control signal GWE2 are output from output terminals into the first gate signal line driver circuit 1201A and the second gate signal line driver circuit 1201B, so that phase shifts of the first scan signal and the second scan signal, and the image signal are corrected.

In addition, a pixel configuration of the pixel 1209 is similar to that of FIG. 2 described in Embodiment Mode 1.

Figure 15:
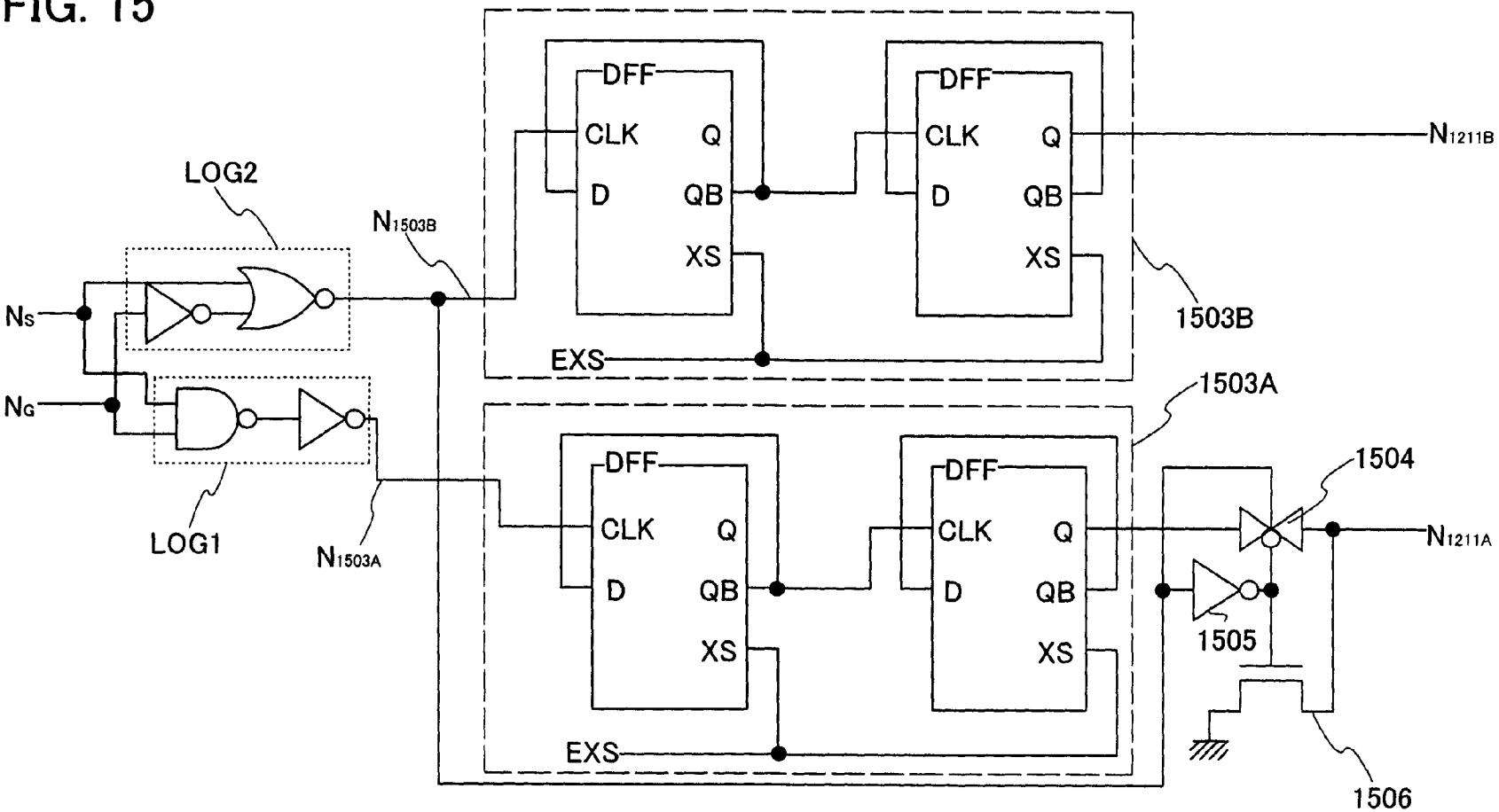
FIG. 15 is a block diagram for showing a configuration of Embodiment Mode 2 of the invention.

Next, a function and a configuration of the phase comparator 1210 in this embodiment mode are described in FIG. 15. In this embodiment mode, a potential in which the potential of the node $N_G$ in the gate line is at a High level and the signal of the node $N_S$ in the source line is lowered to be at a Low level is taken in the pixel as the writing signal; and a potential in which the potential of the node $N_G$ in the gate line is at a High level and the signal of the node $N_S$ in the source line is raised to be at a High level is taken in the pixel as the erasing signal.

In the phase comparator 1210, a logic circuit LOG1 which obtains an AND of the signal of the node $N_S$ in the source line and a signal of the node $N_G$ in the gate line is provided. Specifically, the circuit shown in FIG. 3A in Embodiment Mode 1 is provided. Further, a logic circuit LOG2 which obtains an OR of the signal of the node $N_S$ in the source line and an inverted signal of the signal of the node $N_G$ in the gate line is provided at the same time. Specifically, the circuit shown in FIG. 4A in Embodiment Mode 1 is provided.

Outputs from the logic circuit LOG1 and the logic circuit LOG2 are input into a counter circuit 1503A and a counter circuit 1503B via a node $N_{1503A}$ and a node $N_{1503B}$. Each of the counter circuit 1503A and the counter circuit 1503B in FIG. 15 is formed of a D flip-flop circuit having two stages. Note that the D flip-flop circuit in each of the counter circuit 1503A and the counter circuit 1503B include the circuit in FIG. 6 shown in Embodiment Mode 1.

Note that in each of the counter circuit 1503A and the counter circuit 1503B, a terminal Q in the D flip-flop circuit in a first stage is not connected to a terminal CLK in the D flip-flop circuit in a second stage, and a terminal QB of the D flip-flop circuit in the first stage is connected to the terminal CLK of the D flip-flop circuit in the second stage. In addition, in each of the counter circuit 1503A and the counter circuit 1503B, the set signal EXS is input into a terminal XS in each stage of the D flip-flop circuit.

An input terminal of an analog switch 1504 (also described as an analog switch circuit) is connected to a terminal Q in the D flip-flop circuit in the second stage of the counter circuit 1503A connected to the logic circuit LOG1 through the node $N_{1503A}$. In addition, the node $N_{1503B}$ is connected to a control terminal of the analog switch 1504 and an input terminal of an inverter circuit 1505. An output terminal of the inverter circuit 1505 is connected to an inverted control terminal of the analog switch 1504 and a gate of a transistor 1506. Note that the transistor 1506 is an N-channel transistor in this embodiment mode. When a potential of a signal from the inverter circuit 1505 is at a Low level, the transistor 1506 is turned off and the analog switch 1504 is turned on, so that an output signal from the terminal Q in the D flip-flop circuit in the second stage of the counter circuit 1503A is output from an output terminal of the analog switch 1504 into a node $N_{1211A}$ which is between the phase comparator 1210 and the first counter circuit 1211A in FIGS. 14A and 14B. Alternatively, when the potential of the signal from the inverter circuit 1505 is at a High level, the analog switch 1504 is turned off and the transistor 1506 is turned on, so that a GND potential connected to a first terminal of the transistor 1506 is output from a second terminal of the transistor 1506 into the node $N_{1211A}$ which is between the phase comparator 1210 and the first counter circuit 1211A in FIGS. 14A and 14B.

In addition, an output signal from a terminal Q in the D flip-flop circuit in the second stage of the counter circuit 1503B connected to the logic circuit LOG2 through the node $N_{1503B}$ is output into a node $N_{1211B}$ which is between the phase comparator 1210 and the second counter circuit 1211B in FIGS. 14A and 14B.

Further, a configuration of the second counter circuit 1211B in FIGS. 14A and 14B is similar to that of FIG. 5 in Embodiment Mode 1. Moreover, the D flip-flop circuit in each of the first counter circuit 1211A and the second counter circuit 1211B includes the circuit in FIG. 6 shown in Embodiment Mode 1.

In addition, configurations of the first phase shift circuit 1212A and the second phase shift circuit 1212B in FIGS. 14A and 14B are similar to that of FIG. 8 shown in Embodiment Mode 1. Note that a signal from the first counter circuit 1211A is input into the first phase shift circuit 1212A, and a signal from the second counter circuit 1211B is input into the second phase shift circuit 1212B.

Next, operations of the circuits in FIGS. 14A and 14B in this embodiment mode are described with reference to timing charts in FIGS. 16 to 19. Note that the logic circuit LOG1 and the counter circuit 1503A in FIG. 15 and the first counter circuit 1211A and the first phase shift circuit 1212A in FIGS. 14A and 14B correct a phase shift of the gate signal line and the source signal line due to an operation of writing of the video signal. In addition, the logic circuit LOG2 and the counter circuit 1503B in FIG. 15 and the second counter circuit 1211B and the second phase shift circuit 1212B in FIGS. 14A and 14B correct the phase shift of the gate signal line and the source signal line due to an operation of erasing of the video signal.

Figure 16:
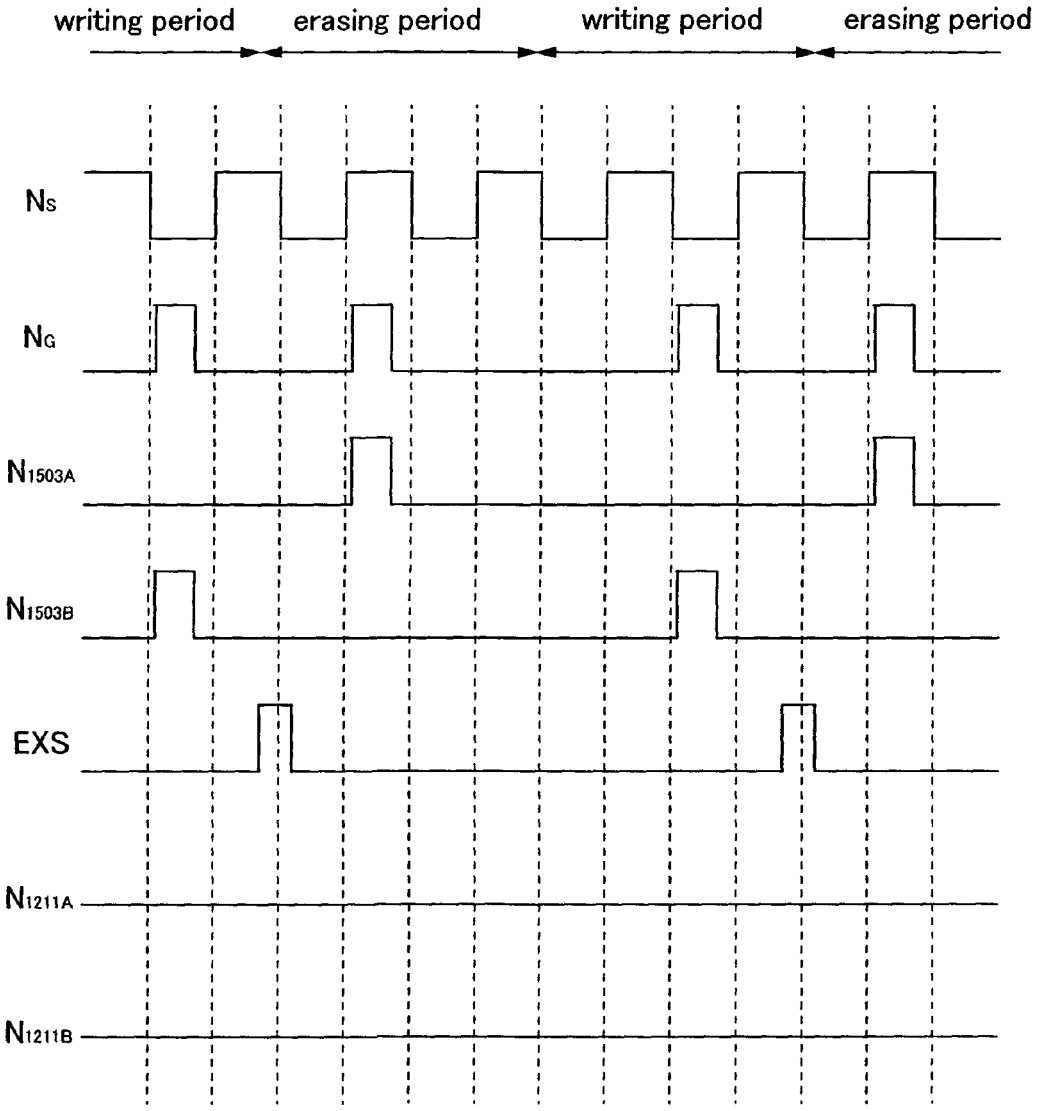
FIG. 16 is a timing chart for showing a phase comparator in Embodiment Mode 2 of the invention.
Figure 17:
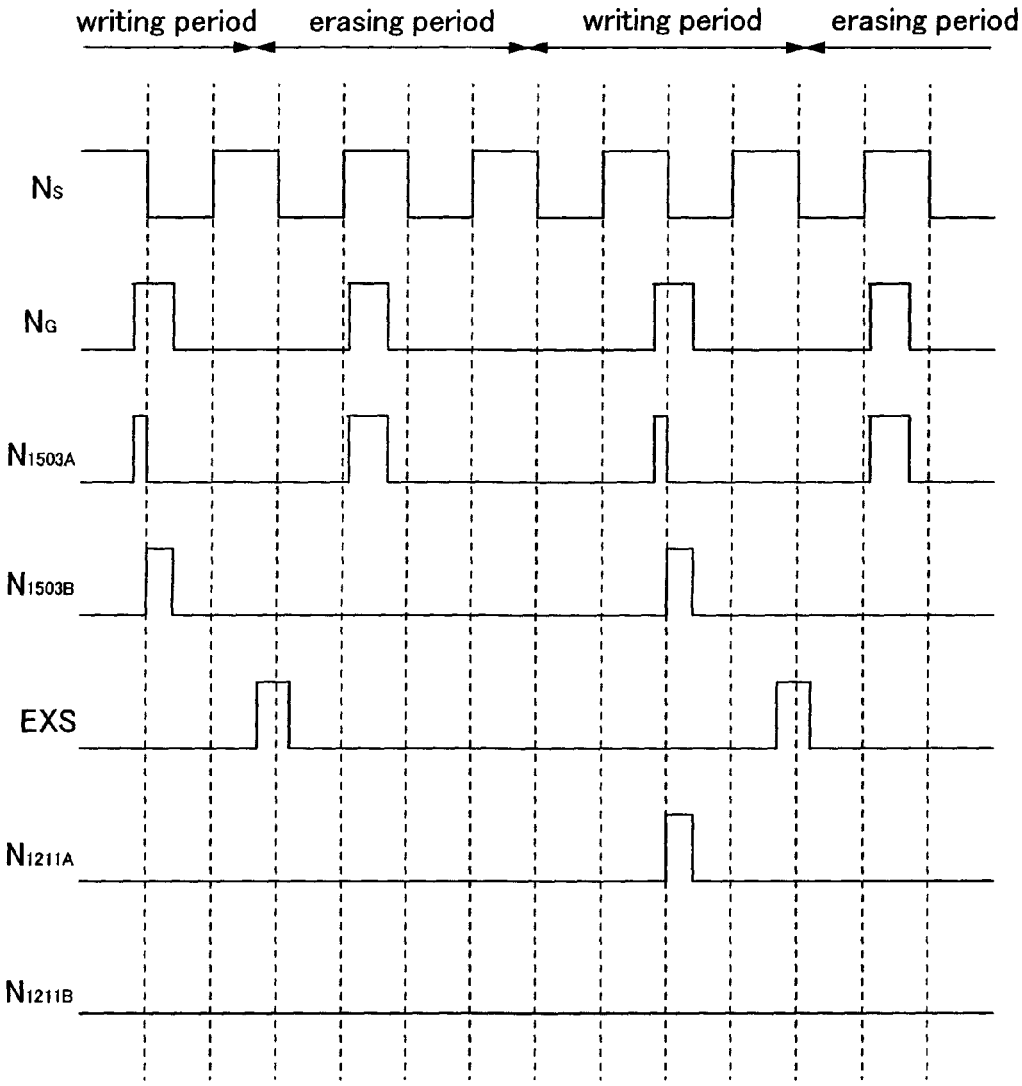
FIG. 17 is a timing chart for showing a phase comparator in Embodiment Mode 2 of the invention.
Figure 18:
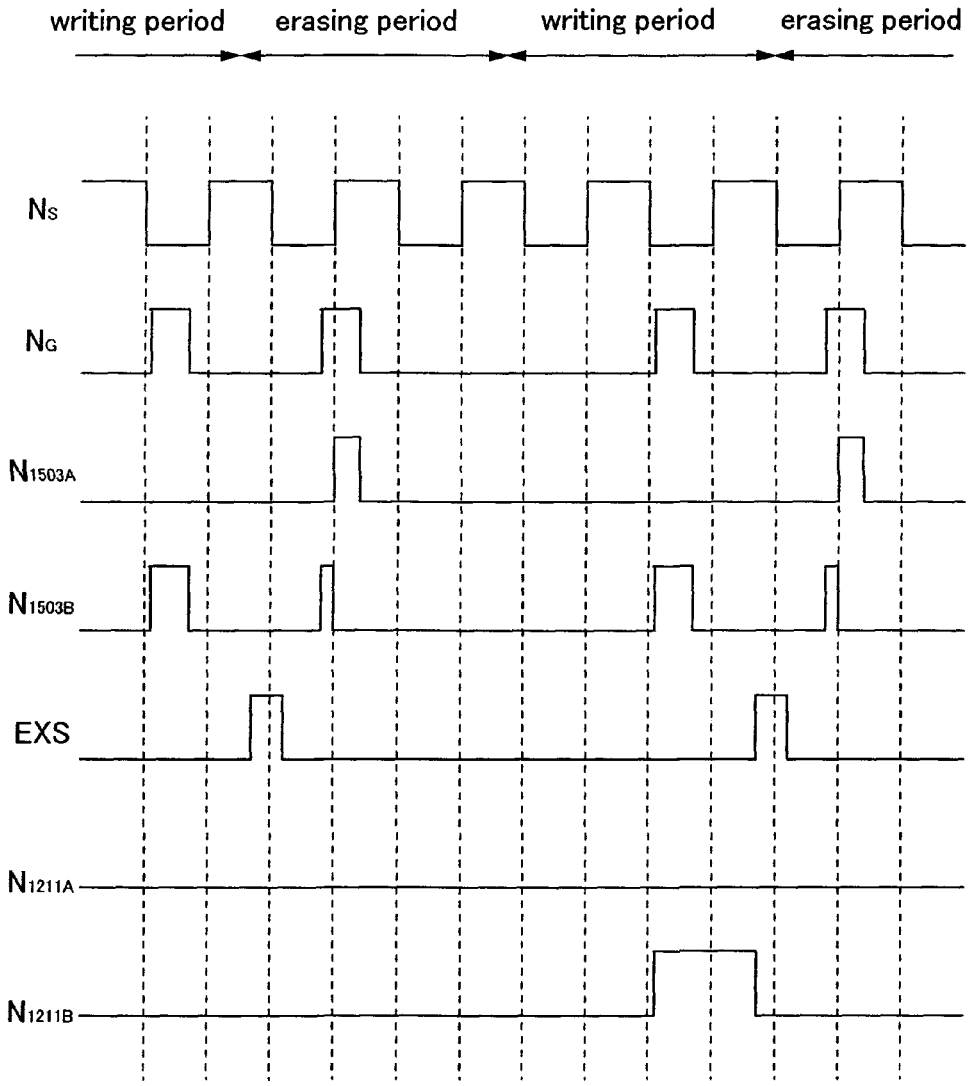
FIG. 18 is a timing chart for showing a phase comparator in Embodiment Mode 2 of the invention.
Figure 19:
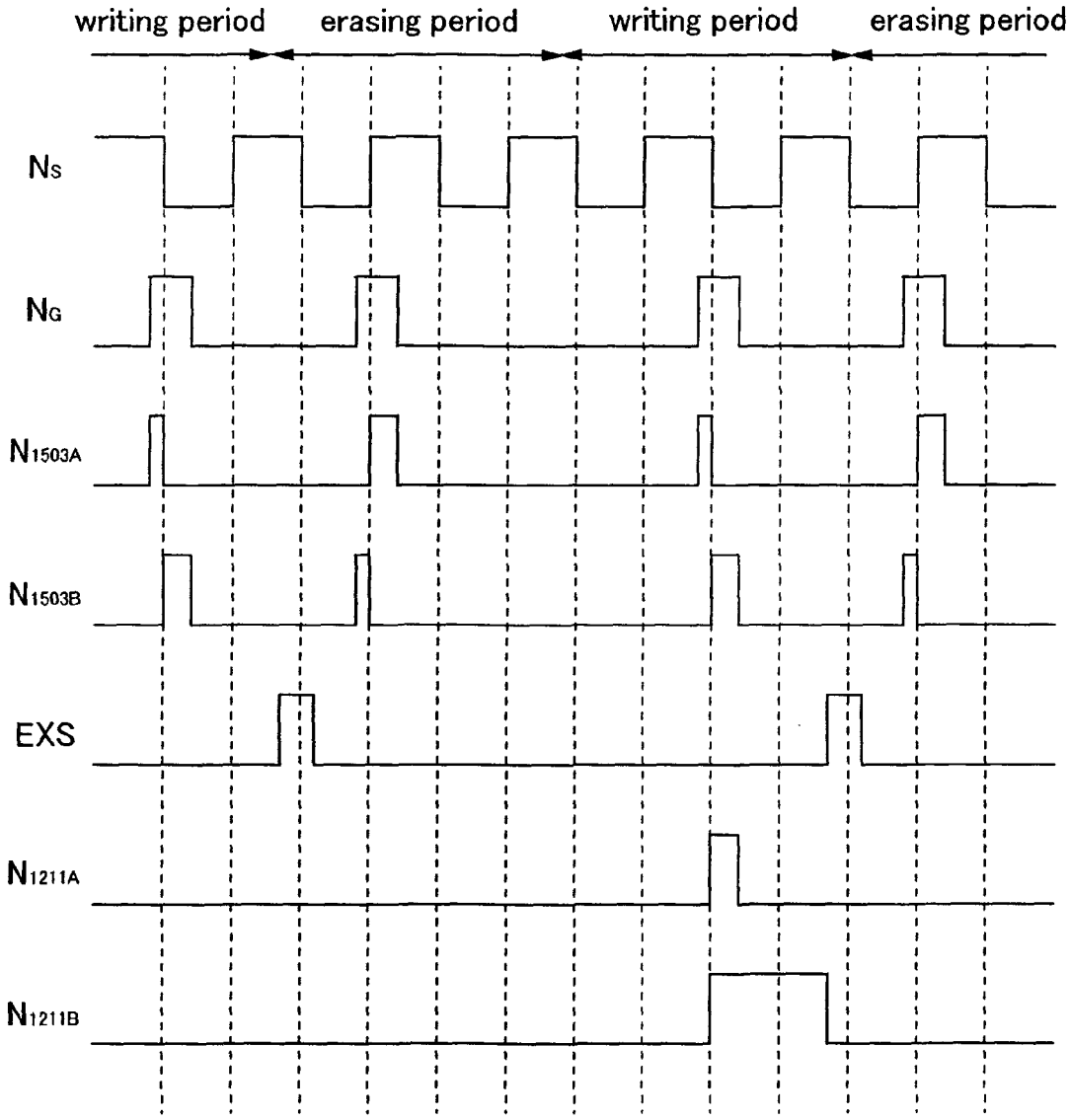
FIG. 19 is a timing chart for showing a phase comparator in Embodiment Mode 2 of the invention.

FIG. 16 shows a timing chart in which a phase of a signal of the source signal line and a phase of a signal of the gate signal line are not shifted at the time of writing of the video signal and writing of the erasing signal. In FIG. 16, a writing period is a period in which a potential of the gate signal line is made at a High level when a potential of the source signal line is at a Low level so that the potential of the source signal line is taken in the pixel; and an erasing period is a period in which the potential of the gate signal line is made at a High level when the potential of the source signal line is at a High level so that the potential held in the pixel is erased. FIG. 17 is a timing chart in the case where the phase of the signal of the gate signal line in the writing period is shifted. FIG. 18 is a timing chart in the case where the phase of the signal of the gate signal line in the erasing period is shifted. FIG. 19 is a timing chart in the case where the phases of the signal of the gate signal line in the writing period and the erasing period are shifted.

In FIG. 16, potentials of the node $N_{1503A}$ and the node $N_{1503B}$ in the phase comparator 1210 in FIGS. 14A and 14B are potentials of signals output from the logic circuit LOG1 and the logic circuit LOG2. In FIG. 16, when the potential of the gate signal line is at a High level and the potential of the source signal line is at a High level, that is, when an operation of erasing of the signal held in the pixel in the erasing period is performed, the potential of the node $N_{1503A}$ which is output becomes a High level in the logic circuit LOG1. In addition, in FIG. 16, when the potential of gate signal line is at a High level and the potential of the source signal line is at a Low level, that is, when an operation of writing of the signal into the pixel in the writing period is performed, the potential of the node $N_{1503B}$ which is output becomes a High level in the logic circuit LOG2. Therefore, the potentials of the node $N_{1503A}$ and the node $N_{1503B}$ become a High level once in accordance with the writing operation and the erasing operation in one horizontal period.

In the writing period, when the potential of gate signal line is at a High level and the potential of the source signal line is at a High level, that is, when the phase of the gate signal line is shifted as shown in FIG. 17 in the writing period, the potential of the node $N_{1503A}$ which is the output is made at a High level in the logic circuit LOG1. In addition, in the erasing period, when the potential of gate signal line is at a High level and the potential of the source signal line is at a Low level, that is, when the phase of the gate signal line is shifted as shown in FIG. 18 in the erasing period, the potential of the node $N_{1503B}$ which is the output is made at a High level in the logic circuit LOG2. Therefore, in one horizontal period, the potentials of the node $N_{1503A}$ and the node $N_{1503B}$ become a High level twice as well as the potentials of the node $N_{1503A}$ and the node $N_{1503B}$ become a High level in accordance with the writing operation and the erasing operation. That is, the potential of the node $N_{1503A}$ or the node $N_{1503B}$ becomes a High level in the case where the potential is changed by a normal writing operation or erasing operation and in the case where the potential is changed due to the phase shift of the gate signal line and the source signal line.

Then, in this embodiment mode, it is a problem that a potential relation of the source signal line and the gate signal line at the time of writing of the video signal is the same as a potential relation in the case where the phases of the source signal line and the gate signal line in the erasing period are shifted in detecting the phase shifts in the source signal line and the gate signal line. Therefore, in the counter circuits provided in the phase comparator in this embodiment mode, the set signal EXS is input every time a first High level or a second High level is input, that is, every time the writing period or the erasing period passes, so that the counter circuits provided in the phase comparator in this embodiment mode determines whether a potential change is due to the normal writing operation or erasing operation by the first High level and the potential change is due to the phase shifts of the gate signal lines and the source signal lines by the second High level.

For example, in the case of FIG. 16 where the phases of the signal of the gate signal line and the source signal line are not shifted in the writing period and the erasing period, in a period where the set signal EXS becomes a High level, both of the node $N_{1503A}$ and the node $N_{1503B}$ become a High level only once, and the counter circuit 1503A and the counter circuit 1503B do not output High-level signals which are signals where the phase shifts are detected into the node $N_{1211A}$ and the node $N_{1211B}$.

In addition, in the case of FIG. 17 where the phase shifts of the signal of the gate signal line and the source signal line are generated in the writing period, in the period where the set signal EXS becomes a High level, the node $N_{1503B}$ which detects the phase shifts of the gate signal line and the source signal line in the erasing period becomes a High level only once, and the counter circuit 1503B does not output the High-level signal which is the signal where the phase shifts are detected into the node $N_{1211B}$. On the contrary, the node $N_{1503A}$ which detects the phase shifts of the gate signal line and the source signal line in the writing period becomes a High level twice, and the counter circuit 1503A outputs the High-level signal which is the signal where the phase shifts are detected into the node $N_{1211A}$.

Further, in the case of FIG. 18 where the phase shifts of the signal of the gate signal line and the source signal line are generated in the erasing period, in the period where the set signal EXS becomes a High level, the node $N_{1503A}$ which detects the phase shifts of the gate signal line and the source signal line in the writing period becomes a High level only once, and the counter circuit 1503A does not output the High-level signal which is the signal where the phase shifts are detected into the node $N_{1211A}$. On the contrary, the node $N_{1503B}$ which detects the phase shifts of the gate signal line and the source signal line in the erasing period becomes a High level twice, and the counter circuit 1503B outputs the High-level signal which is the signal where the phase shifts are detected into the node $N_{1211B}$.

In the case of FIG. 19 where the phase shifts of the signal of the gate signal line and the source signal line are generated in the writing period and the erasing period, in the period where the set signal EXS becomes a High level, the node $N_{1503A}$ which detects the phase shifts of the gate signal line and the source signal line in the writing period becomes a High level twice, and the counter circuit 1503A outputs the High-level signal which is the signal where the phase shifts are detected into the node $N_{1211A}$. In addition, the node $N_{1503B}$ which detects the phase shifts of the gate signal line and the source signal line in the erasing period becomes a High level twice, and the counter circuit 1503B outputs the High-level signal which is the signal where the phase shifts are detected into the node $N_{1211B}$.

Figure 20:
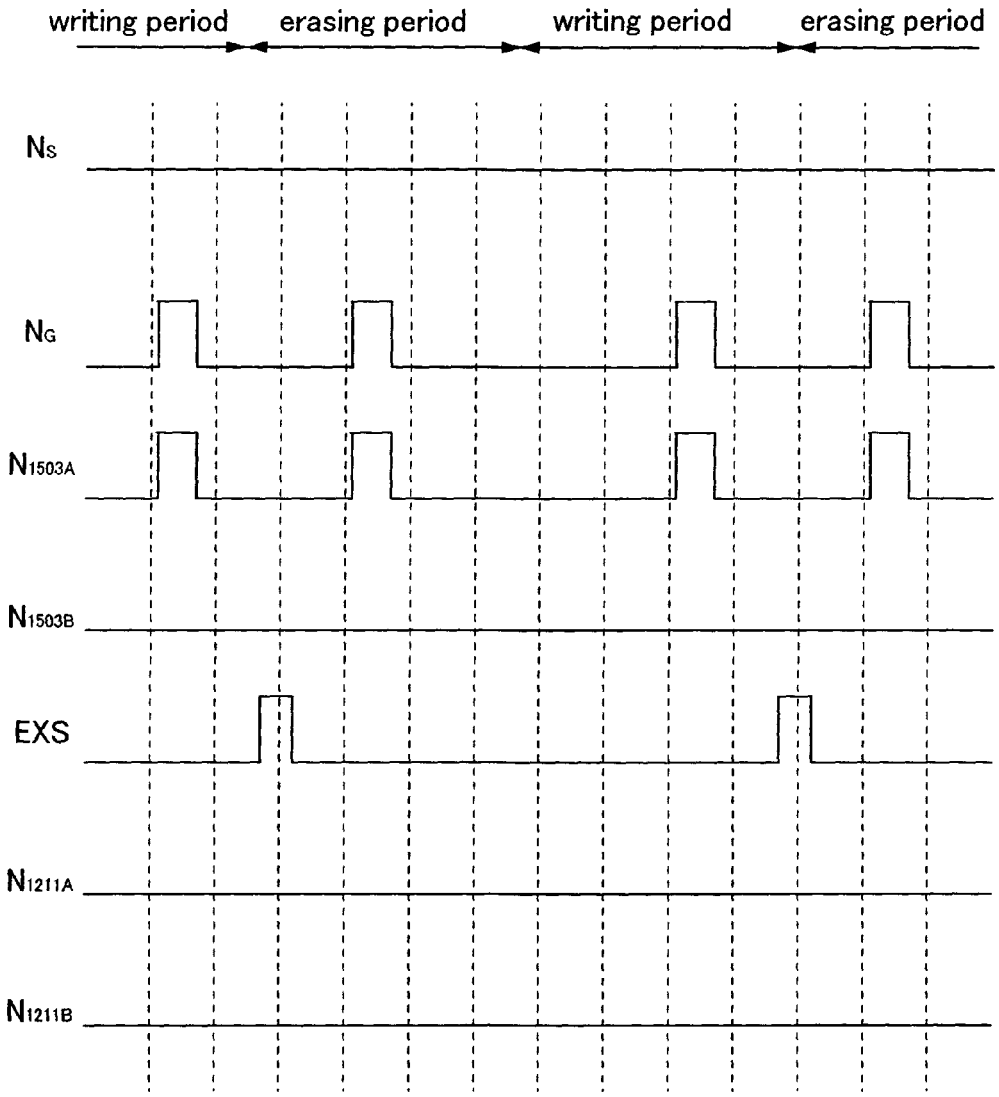
FIG. 20 is a timing chart for showing a phase comparator in Embodiment Mode 2 of the invention.

The analog switch 1504 connected to an output terminal of the counter circuit 1503A which counts the phase shifts of the signals in the writing period is a switch for preventing a defect of compensation which generates when the signal of the source signal line is at a High level, that is, when display is black display. As an example, FIG. 20 shows a timing chart when the signal of the source signal line is at a High level, that is, when display is black display. The potential of the source signal line shown in FIG. 20 is constantly held at a High level. As shown in FIG. 20, in the period where the set signal EXS becomes a High level, the node $N_{1503A}$ which detects the phase shifts of the gate signal line and the source signal line in the writing period becomes a High level twice, and the counter circuit 1503A outputs the High-level signal which is the signal where the phase shifts are detected into the node $N_{1211A}$.

Note that the node $N_{1503B}$ which detects the phase shifts of the gate signal line and the source signal line in the erasing period outputs a High-level signal when the potential of the gate signal line is at a High level and the potential of the source signal line is at a Low level, so that the node $N_{1503B}$ becomes always at a Low level. At this time, a potential level of the node $N_{1503B}$ is input into a gate of the transistor 1506 through the inverter circuit 1505 without making the analog switch 1504 into an on state. That is, a High-level signal is input into the gate of the transistor 1506 through the inverter circuit 1505 when the node $N_{1503B}$ is at a Low level; the transistor 1506 is turned on since it is an N-channel transistor; and the GND potential connected to the first terminal of the transistor 1506 is output from the second terminal of the transistor 1506 into the node $N_{1211A}$ which is between the phase comparator 1210 and the counter circuit 1211A in FIGS. 14A and 14B. Accordingly, the phase comparator 1210 can compare phases only when the potential of the source signal line is at a Low level, and in the period in which the potential of the source signal line is at a High level, even when the counter circuit 1503B outputs a signal in which the phase shifts are detected although the phases are not shifted as shown in FIG. 20, the counter circuit 1503B does not output the signal by on/off of the analog switch 1504 and on/off of the transistor 1506. Further, the transistor 1506 and the GND potential connected to the analog switch 1504 prevent the node $N_{1211A}$ from being a floating potential when the analog switch 1504 is turned off, so that the GND potential can be made at a Low level.

FIG. 4B shows the case where the signal of the source line and the signal of the gate line are normal signals in the circuit in FIG. 4A. In addition, FIG. 4C shows the case where the phase of the signal of the gate line is shifted from the phase of the signal of the source line so that a normal phase relationship is not provided in the circuit in FIG. 4A. The node $N_{111}$ on the counter circuit 111 side outputs a Low-level signal in FIG. 4B, whereas the node $N_{111}$ on the counter circuit 111 side outputs a High-level signal in accordance with the phase shift in FIG. 4C.

By employing the configuration in this embodiment mode, particularly in the case of driving by using a digital driving method in an active matrix display device and performing input and output of an image signal input into the pixel in the one horizontal period by one scan line, phase shifts of signals are counted and restored inside the display device so that normal display can be obtained, even when phases of a scan signal and an image signal input into a pixel portion are shifted by dullness or delay of the signals caused by resistance, a capacitance component, or the like of the wiring to which the signals are supplied.

Note that the configuration of each circuit in this embodiment mode is just an example, so that the invention is not limited to this. That is, in the aforementioned phase comparator, any circuit may be employed as long as it can separately detect phase shifts of two kinds of signals supplied to one of two wirings which are connected and output the signals. In addition, in the aforementioned first counter circuit and second counter circuit, any circuit may be employed as long as it separately counts the phase shifts of two kinds of the signals detected by the phase comparator and outputs a signal in accordance with the number of counts. Further, in the aforementioned first phase shift circuit and second phase shift circuit, any circuit may be employed as long as it separately shifts the phases of two kinds of the signals supplied to one of the two wirings which are connected based on the number of the counts in the first counter circuit or the second counter circuit.

Note that this embodiment mode can be combined with another embodiment mode in this specification as appropriate and implemented.

[Embodiment 1]

A video camera, a digital camera, a goggle display (a head mounted display), a navigation system, an audio reproducing device (e.g., a car audio or audio component set), a laptop computer, a game machine, a portable information terminal (e.g., a mobile computer, a mobile phone, a mobile game machine, or an electronic book), an image reproducing device provided with a recording medium (specifically, a device for reproducing a content of a recording medium such as a Digital Versatile Disc (DVD) and having a display which can display an reproduced image), and the like are given as electronic devices using a display device of the invention. FIGS. 21A to 21H show specific examples of the electronic devices.

Figure 21A:
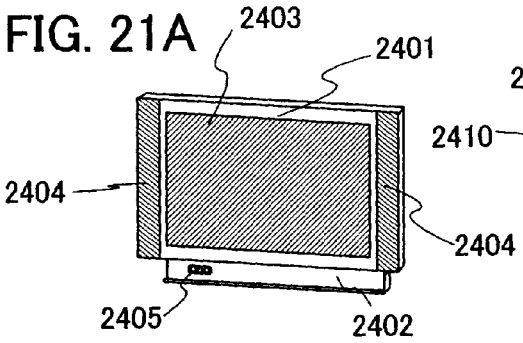
FIGS. 21A to 21H are views showing examples of an electronic device to which the invention is applied.

FIG. 21A shows a light-emitting device, which includes a housing 2401, a support base 2402, a display portion 2403, speaker portions 2404, a video input terminal 2405, and the like. The invention can be applied to a display device for forming the display portion 2403. By employing the invention, a display defect is reduced so that a clearer image can be viewed. Note that all of display devices for displaying information such as those for personal computers, television broadcast reception, and advertisement display are included in the light-emitting device.

Figure 21B:
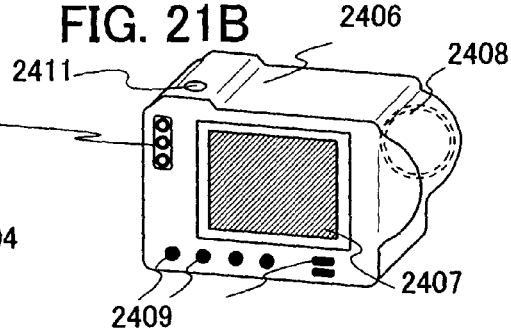

FIG. 21B shows a digital still camera, which includes a main body 2406, a display portion 2407, an image receiving portion 2408, operating keys 2409, an external connecting port 2410, a shutter 2411, and the like. The invention can be applied to a display device for forming the display portion 2407. By employing the invention, a display defect is reduced so that a clearer image can be viewed.

Figure 21C:
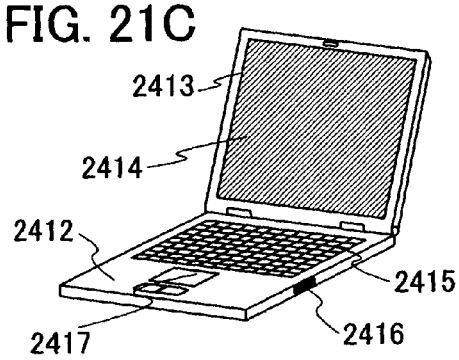

FIG. 21C shows a laptop computer, which includes a main body 2412, a housing 2413, a display portion 2414, a keyboard 2415, an external connecting port 2416, a pointing device 2417, and the like. The invention can be applied to a display device for forming the display portion 2414. By employing the invention, a display defect is reduced so that a clearer image can be viewed.

Figure 21D:
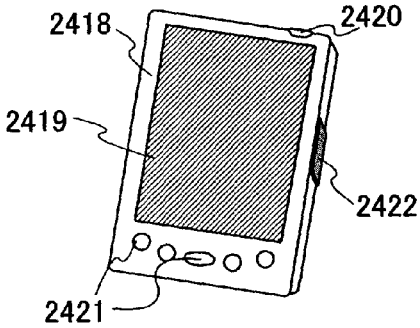

FIG. 21D shows a mobile computer, which includes a main body 2418, a display portion 2419, a switch 2420, operating keys 2421, an infrared port 2422, and the like. The invention can be applied to a display device for forming the display portion 2419. By employing the invention, a display defect is reduced so that a clearer image can be viewed.

Figure 21E:
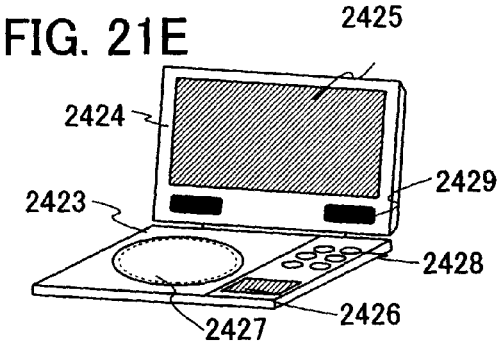

FIG. 21E shows a portable image reproducing device provided with a recording medium (specifically, a DVD player), which includes a main body 2423, a housing 2424, a display portion A 2425, a display portion B 2426, a recording medium (e.g., DVD) reading portion 2427, operating keys 2428, speaker portions 2429, and the like. The display portion A 2425 mainly displays image data and the display portion B 2426 mainly displays text data. The invention can be applied to a display device for forming the display portion A 2425 and the display portion B 2426. By employing the invention, a display defect is reduced so that a clearer image can be viewed. Note that a home-use game machine and the like are included in the image reproducing device provided with the recording medium.

Figure 21F:
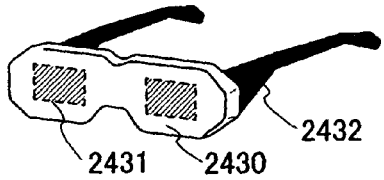

FIG. 21F shows a goggle display (a head mounted display), which includes a main body 2430, display portions 2431, arm portions 2432, and the like. The invention can be applied to a display device for forming the display portions 2431. By employing the invention, a display defect is reduced so that a clearer image can be viewed.

Figure 21G:
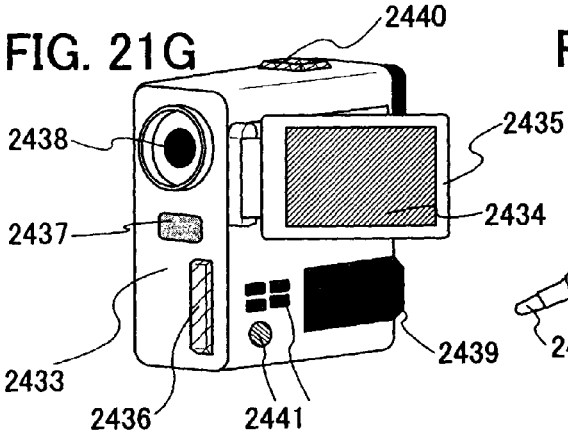

FIG. 21G shows a video camera, which includes a main body 2433, a display portion 2434, a housing 2435, an external connecting port 2436, a remote control receiving portion 2437, an image receiving portion 2438, a battery 2439, an audio input portion 2440, operating keys 2441, and the like. The invention can be applied to a display device for forming the display portion 2434. By employing the invention, a display defect is reduced so that a clearer image can be viewed.

Figure 21H:
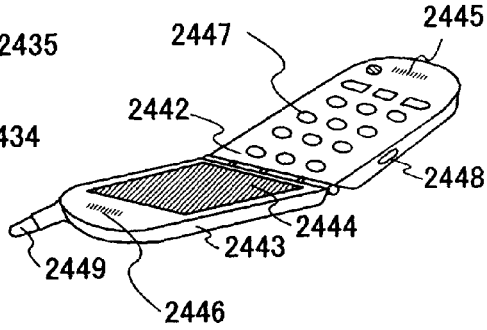

FIG. 21H shows a mobile phone, which includes a main body 2442, a housing 2443, a display portion 2444, an audio input portion 2445, an audio output portion 2446, operating keys 2447, an external connecting port 2448, an antenna 2449, and the like. The invention can be applied to a display device for forming the display portion 2444. Note that the display portion 2444 displays a white character in a black background so that current consumption of the mobile phone can be suppressed. In addition, by employing the invention, a display defect is reduced so that a clearer image can be viewed.

As described above, an application range of the invention is extremely wide and the invention can be applied to electronic devices in all fields. In addition, the electronic devices in this embodiment can apply display devices using any one of the configurations described in Embodiments Modes 1 and 2.

This application is based on Japanese Patent Application serial No. 2006-047194 filed in Japan Patent Office on Feb. 23, 2006, the entire contents of which are hereby incorporated by reference.

What is claimed is:

1. A display device comprising:

a gate signal line;

a source signal line;

a phase comparator;

a counter circuit; and a phase shift circuit, wherein the phase comparator is directly connected to the gate signal line and the source signal line, wherein the phase comparator directly compares a phase of a scan signal output from a gate signal line driver circuit into the gate signal line and a phase of an image signal output from a source signal line driver circuit into the source signal line, wherein the counter circuit counts the number of signals output from the phase comparator, and wherein the phase shift circuit shifts the phase of the signal output into the gate signal line in accordance with a signal output from the counter circuit.

2. The display device according to claim 1, wherein the phase comparator includes a logic circuit.

3. The display device according to claim 1, wherein the counter circuit includes a flip-flop circuit and a plurality of logic circuits which output a signal in accordance with a signal output from the flip-flop circuit.

4. The display device according to claim 2, wherein the counter circuit includes a flip-flop circuit and a plurality of logic circuits which output a signal in accordance with a signal output from the flip-flop circuit.

5. The display device according to claim 1, wherein the phase shift circuit includes a shift register circuit which shifts the phase of the signal output into the gate signal line and an analog switch provided in each stage of the shift register circuit, and on/off of the analog switch is switched in accordance with the number of signals counted in the counter circuit.

6. The display device according to claim 2, wherein the phase shift circuit includes a shift register circuit which shifts the phase of the signal output into the gate signal line and an analog switch provided in each stage of the shift register circuit, and on/off of the analog switch is switched in accordance with the number of signals counted in the counter circuit.

7. The display device according to claim 3, wherein the phase shift circuit includes a shift register circuit which shifts the phase of the signal output into the gate signal line and an analog switch provided in each stage of the shift register circuit, and on/off of the analog switch is switched in accordance with the number of signals counted in the counter circuit.

8. The display device according to claim 4, wherein the phase shift circuit includes a shift register circuit which shifts the phase of the signal output into the gate signal line and an analog switch provided in each stage of the shift register circuit, and on/off of the analog switch is switched in accordance with the number of signals counted in the counter circuit.

9. An electronic device provided with the display device according to claim 1.

10. A display device comprising:

a pixel;

a first signal line for outputting a scan signal from a gate signal line driver circuit, the first signal having a scan phase to the pixel;

a second signal line for outputting an image signal from a source signal line driver circuit, the image signal having a second phase to the pixel;

a phase comparator for directly comparing the first phase and the second phase, and for outputting a first signal;

a counter circuit for counting the number of the first signal, and outputting a second signal in accordance with the number of the first signal; and a phase shift circuit for shifting a phase of the scan signal based on the second signal, wherein the phase comparator is directly connected to the first signal line and the second signal line.

11. The display device according to claim 10, wherein the phase comparator includes a logic circuit.

12. The display device according to claim 10, wherein the counter circuit includes a flip-flop circuit outputting a signal, and a plurality of logic circuits which output a signal in accordance with the signal output from the flip-flop circuit.

13. The display device according to claim 11, wherein the counter circuit includes a flip-flop circuit outputting a signal, and a plurality of logic circuits which output a signal in accordance with the signal output from the flip-flop circuit.

14. The display device according to claim 10, wherein the phase shift circuit includes a shift register circuit which shifts the first phase, and an analog switch provided in the shift register circuit, and wherein an on/off of the analog switch is switched in accordance with the second signal.

15. The display device according to claim 11, wherein the phase shift circuit includes a shift register circuit which shifts the first phase, and an analog switch provided in the shift register circuit, and wherein an on/off of the analog switch is switched in accordance with the second signal.

16. The display device according to claim 12, wherein the phase shift circuit includes a shift register circuit which shifts the first phase, and an analog switch provided in the shift register circuit, and wherein an on/off of the analog switch is switched in accordance with the second signal.

17. The display device according to claim 13, wherein the phase shift circuit includes a shift register circuit which shifts the first phase, and an analog switch provided in the shift register circuit, and wherein an on/off of the analog switch is switched in accordance with the second signal.

18. An electronic device provided with the display device according to claim 10.

* * * * *